US012429293B1

(12) United States Patent
Gurov et al.

(10) Patent No.: US 12,429,293 B1
(45) Date of Patent: Sep. 30, 2025

(54) PLATE HEAT EXCHANGER COMPRISING PLATES WITH CUTOUTS

(71) Applicant: PRMF "ANKOR-TEPLOENERGO", Kharkov (UA)

(72) Inventors: Oleg Gurov, Kharkov (UA); Kyrylo Gurov, Kharkov (UA)

(73) Assignee: PRMF "ANKOR-TEPLOENERGO", Kharkov (UA)

( * ) Notice: Subject to any disclaimer, the term of this patent is extended or adjusted under 35 U.S.C. 154(b) by 0 days.

(21) Appl. No.: 19/045,206

(22) Filed: Feb. 4, 2025

(51) Int. Cl.
*F28F 3/12* (2006.01)

(52) U.S. Cl.
CPC ..... *F28F 3/12* (2013.01)

(58) Field of Classification Search
CPC ..... F28F 3/12; F28F 3/02; F28F 3/042
USPC ..... 165/166
See application file for complete search history.

(56) References Cited

U.S. PATENT DOCUMENTS 4,975,803 A * 12/1990 Niggemann ..... F28D 15/0266 361/702
5,193,611 A * 3/1993 Hesselgreaves ..... F28F 3/02 29/890.039
5,423,376 A * 6/1995 Julien ..... H01L 23/473 257/E23.098
6,953,009 B2 * 10/2005 Reinke ..... F28D 9/005 122/31.1
8,967,238 B2 * 3/2015 Meschke ..... F28F 13/12 165/170
11,109,511 B2 * 8/2021 Oguri ..... H01L 21/4871
2006/0108100 A1 * 5/2006 Goldman ..... F28F 3/048 165/170
2007/0246204 A1 * 10/2007 Lai ..... H01L 23/473 257/E23.098

FOREIGN PATENT DOCUMENTS

EP 1995545 A2 * 11/2008 ..... F28D 9/0006
WO WO-02077557 A1 * 10/2002 ..... F28D 9/0031

OTHER PUBLICATIONS

English translation of EP-1995545A2 (Year: 1995).*

* cited by examiner

*Primary Examiner* — Tho V Duong
(74) *Attorney, Agent, or Firm* — Abel Schillinger, LLP

(57) ABSTRACT

A plate heat exchanger comprises at least one unit comprising four plates, namely a plate pack comprising a first plate having transversely extending cutouts therein and an adjacent second plate having transversely extending cutouts therein, the plate pack being sandwiched between two solid plates without cutouts. At least some of the cutouts of the first plate intersect at least some of the cutouts of the second plate.

20 Claims, 17 Drawing Sheets

PLATE HEAT EXCHANGER COMPRISING PLATES WITH CUTOUTS

BACKGROUND OF THE INVENTION

1. Field of the Invention

The present invention relates to a plate heat exchanger (PHE) and in particular, a plate heat exchanger which comprises plates with cutouts.

2. Discussion of Background Information

Heat exchangers are used in different industrial processes for heating or cooling media (liquids and gases, including air). Heat exchangers can be of different types, such as for example, shell and tube heat exchangers, spiral heat exchangers, gasket heat exchangers, plate heat exchangers, and brazed heat exchangers.

In the production of known PHEs thin-sheet corrugated plates are connected inseparably (for example, by welding or soldering) in a package that can be installed in the power housing of the PHE (see FIG. 1). Alternatively, the package may not be installed in the housing but is instead directly welded to collector branch pipes (see FIG. 2).

The efficiency and cost of a PHE depends on the design of the corrugated plates that provide the thermal-hydraulic mode of the PHE for specific technological tasks, making it necessary to manufacture corrugated plates with specific characteristics and overall dimensions which makes the manufacture of corresponding plates very expensive, especially in case of large overall dimensions of the plates.

In view of the foregoing, it would be advantageous to be able to significantly reduce the costs of the production of a PHE, especially a PHE for operation at high temperatures and/or high pressures.

SUMMARY OF THE INVENTION

The present invention provides a plate heat exchanger which comprises at least a first unit that comprises four rectangular (e.g., square) plates of identical size, namely a plate pack of a first plate having cutouts therein and an adjacent second plate having cutouts therein, the plate pack being sandwiched between two solid plates without cutouts. The cutouts of the first and second plates extend transversely from the vicinity of an edge at one side of the plate towards the vicinity of an edge at the opposite side of the plate and form two groups of cutouts: a first group of cutouts which are closed at both ends thereof in the vicinities of the edges at opposite sides of the plate, and a second group of cutouts which are closed at only one end thereof, i.e., in the vicinity of the edge at one side of the plate from which they extend, an end opposite to the closed end of the cutout terminating in one of the edges of the plate which are perpendicular to the edges of the plate from whose vicinities the cutouts originate, thereby forming gaps in the perpendicular edges. Alternatively, and if each of the two plates additionally comprises two longitudinal cutouts which extend parallel to, and in the vicinities of, edges at perpendicular sides of a plate and both of these cutouts have one closed end and one end merging into a collector hole located in the vicinity of the closest corner of the plate, the second group of cutouts merges into one of the longitudinal cutouts which extend parallel to the perpendicular sides instead of terminating in one of the edges of the perpendicular sides. The two plates of the plate pack may be identical or may differ from each other with respect to at least one of the plate thicknesses, the number of cutouts in a plate, the width of the cutouts, the configuration of the cutouts, the distance between the cutouts, and the inclination of the cutouts. Usually, the two plates of the plate pack are identical. Further, one of the first and second plates with cutouts is rotated by 180° around a central symmetry axis which is parallel to the sides of the first and second plates at which the cutouts are closed or, in the case of plates with longitudinal cutouts merging into a collector hole, is rotated by 180° around a central symmetry axis of the first and second plates which is parallel to the sides with longitudinal cutouts, resulting in at least some of the cutouts of the first plate intersecting at least some of the cutouts of the second plate. For example, a total of at least five cutouts in one plate may be intersected by a total of at least five cutouts in the other plate.

In this regard, it is pointed out that the plate pack of the first and second plates, while referred to herein as a single plate pack, may consist of two or more smaller plate packs of identical or different size (e.g., four plate packs or nine plate packs), densely spaced in the same plane between the solid plates and together forming the final plate pack, which abut along their open sides and/or their closed sides and together form the final plate pack (see FIG. 6B). A corresponding configuration of a (final) plate pack may be advantageous, for example, in a case where the desired dimensions of a unit are relatively large and it is considerably easier to manufacture smaller plate packs and combine several of them to form the final plate pack instead of manufacturing the final plate pack in one piece.

In a first embodiment of the PHE of the invention, the heat exchanger further comprises at least a second unit which is arranged above or below the first unit and is of the same general design as the first unit, i.e., also comprises a plate pack of adjacent first and second plates with intersecting cutouts sandwiched between two solid plates. In this case the solid plate of the second unit which is adjacent to the first unit usually also serves as the solid plate of the first unit which is adjacent to the second unit (i.e., the first and second unit share one solid plate). The plate pack of the second unit may be the same as the plate pack of the first unit or may differ therefrom with respect to at least one of the thicknesses of the first and second plates, the number of cutouts in the first and second plates, the width of the cutouts in the first and second plates, the distance between the cutouts in the first and second plates, the configuration of the cutouts, and the inclination of the cutouts in the first and second plates. With the plate packs of the first and second units parallel to each other, one of the plate packs is rotated by 90° around a central axis which is perpendicular to the planes of the plate packs of the first and second units.

In a second embodiment of the heat exchanger of the invention, the heat exchanger further comprises at least two further (second and third) units which are arranged above and below the first unit, respectively and are of the same design as the first unit, also comprising a plate pack of adjacent first and second plates with intersecting cutouts sandwiched between two solid plates. The solid plate of the second unit which is arranged adjacent to and above the first unit also serves as the solid plate of the first unit which is adjacent to the second unit (i.e., the first and second units share a solid plate) and the solid plate of the third unit which is arranged adjacent to and below the first unit also serves as the solid plate of the first unit which is adjacent to the third unit (i.e., the first and third unit share a solid plate, which is the second solid plate of the first unit). The plate packs of the second and third units may be the same as the plate pack of the first unit or may differ therefrom and/or from each other with respect to at least one of the thicknesses of the first and second plates, the number of the cutouts in the first and second plates, the width of the cutouts in the first and second plates, the distance between the cutouts in the first and second plates, the configuration of the cutouts in the first and second plates, and the inclination of the cutouts in the first and second plates. Usually, the second and third units are identical. With all three plate packs parallel to each other, the plate packs of the second and third units are both rotated by 90° around the central axis which is perpendicular to the planes of the plate packs.

In a third embodiment of the heat exchanger of the invention, the heat exchanger of the second embodiment further comprises one additional (fourth) unit which is arranged above or below the second unit or third unit, respectively, and is of the same design as the first to third units. Further, the heat exchanger of the second embodiment may comprise not just one but two additional (fourth and fifth) units which are arranged above or below the second unit or third unit, respectively, and are of the same design as the first to third units. In each of these further embodiments the plate packs of the first and fourth units or of the first, fourth and fifth units are parallel and perpendicular to the parallel second and third units (but in parallel planes).

Of course, it is possible to add one or more units to the heat exchanger of the third embodiment. For example, a heat exchanger may comprise up to 20, e.g., up to 10 units, each with plate packs that alternate with regard to their orientation (each time with a rotation by 90 degrees).

In one embodiment of the heat exchanger of the invention, all plates of the at least one unit are made of the same material. In another embodiment, the plates may be made of different materials. For example, the plates with cutouts and the solid plates of a unit may be made of different materials. For example, a plate may be made of a metal such as iron, nickel or chrome or may be made of an alloy such as, e.g., (optionally stainless) steel. Also, if more than one unit is present, at least some of the plates of one unit may be made of a material that is different from a material which is used for the plates of the other unit.

In one embodiment, the thickness of the solid plates of a unit is from 0.5 mm to 2 mm and/or the thickness of the first and second plates with cutouts of a unit is from 1 mm to 5 mm. Higher and lower thicknesses are possible as well. The thickness of the plates may be determined to at least some extent by the heat conductivity of the material(s) of the plates, materials with relatively high heat conductivity (and high corrosion resistance) being preferred.

The thicknesses of the two plates of the plate pack of a unit are the same or different, preferably the same. The same applies to the thicknesses of the two solid plates of a unit. The thickness of the plates of a plate pack usually is the same or higher than the thickness of the solid plates of a unit.

In one embodiment, the sides of the rectangular plates of a unit are from 50 mm to 1000 mm long and/or the width of the cutouts in the first and second plates with cutouts is from 3 mm to 20 mm and/or the distance between two cutouts is from 2 mm to 20 mm_(and/or about the same as the width of the cutouts) and/or the angle formed between an edge of a plate and a cutout from whose vicinity the cutout originates is from 10 degrees to 75 degrees, e.g., from 30 degrees to 60 degrees and/or the distance between an edge of the plate and the closed end of a cutout in whose vicinity the cutout originates is from 6 mm to 12 mm. However, higher or lower dimensions are possible as well. All cutouts of a plate usually have the same width and/or are parallel to each other, preferably both.

The cutouts of a plate can have any conceivable configuration as long as they extend generally transversely form the vicinity of an edge at one side of the plate towards the vicinity of an edge on the opposite side of the plate, and at least some of the cutouts of one plate of a plate pack intersect at least some of the cutouts of the other plate of the plate pack. The cutouts will often have a rectilinear configuration but other configurations such as, e.g., curvilinear (e.g., wavy), broken (e.g., rectilinear and broken) are suitable as well. Usually, the cutouts of the first and second plates of a plate pack have the same configuration. An individual plate of a plate pack may even comprise cutouts with two or more different configurations such as, e.g., (for example, alternating) rectilinear and curvilinear cutouts. If a (final) plate pack consists of two or more smaller plate packs the cutouts in one of the smaller plate packs which is a part of the final plate pack may be the same as or different from the cutouts in another one of the smaller plate packs, although they are usually the same.

In one embodiment, the first and second plates of a plate pack (both in a final plate pack and in a smaller plate pack constituting a component of a final plate pack) are identical.

In one embodiment of the first and second embodiments of the heat exchanger of the invention, all plate packs are identical or at least all plate packs with the same orientation are identical.

In one embodiment of the heat exchanger, all plates of a unit and all units are connected to each other by soldering and/or welding. The two plates of a plate pack may optionally be preliminarily (before the final assembly) be connected, for example by spot welding.

In one embodiment, the heat exchanger comprises a power housing (see FIG. 1). In another embodiment plates of the heat exchanger are directly welded to collector branch pipes (see FIG. 2).

The present invention also provides a unit which is suitable for use in a heat exchanger of the invention as set forth above. The unit comprises four rectangular plates of identical outer dimensions, namely a plate pack of a first plate having cutouts therein and an adjacent second plate having cutouts therein, the plate pack being sandwiched between two solid plates without cutouts. The cutouts of the first and second plates extend transversely from the vicinity of an edge at one side of the plate towards the vicinity of an edge at the opposite side of the plate and form two groups of cutouts: a first group of cutouts which are closed at both ends thereof in the vicinities of the edges at opposite sides of the plate, and a second group of cutouts which are closed at only one end thereof, i.e., in the vicinity of the edge at one side of the plate from which they extend, an end opposite to the closed end of the cutout, terminating in one of the edges of the plate which are perpendicular to the edges of the plate from whose vicinities the cutouts originate, thereby forming gaps in the perpendicular edges. Alternatively, and if each of the two plates additionally comprises two longitudinal cutouts which extend parallel to, and in the vicinities of, edges at perpendicular sides of a plate and both of these cutouts have one closed end and one end merging into a collector hole located in the vicinity of the closest corner of the plate, the second group of cutouts merges into one of the longitudinal cutouts which extend parallel to the perpendicular sides instead of merging into one of the edges of the perpendicular sides. The two plates of the plate pack may be identical or may differ with respect to at least one of the plate thicknesses, the number of cutouts in the plate, the width of the cutouts, the distance between the cutouts, the configuration of the cutouts, and the inclination of the cutouts. Further, one of the first and second plates with cutouts is rotated by 180° around a central symmetry axis which is parallel to the sides of the first and second plates from which the cutouts originate or, in the case of plates with longitudinal cutouts merging into a collector hole, rotated by 180° around a central symmetry axis of the first and second plates which is parallel to the sides with longitudinal cutouts, resulting in at least some of the cutouts of the first plate of a plate pack intersecting at least some of the cutouts of the second plate of the plate pack. Merely by way of example, a total of at least five cutouts in one plate may be intersected by a total of at least five cutouts in the other plate.

The present invention further provides a plate pack which is suitable for use in the at least one unit of the heat exchanger of the invention (both as a final plate pack and a small plate pack which is a component of a final plate pack). The plate pack comprises a first plate having cutouts therein and an adjacent second plate having cutouts therein. The cutouts of the first and second plates extend transversely from the vicinity of an edge at one side of the plate towards the vicinity of an edge at the opposite side of the plate and form two groups of cutouts: a first group of cutouts which are closed at both ends thereof in the vicinities of the edges at opposite sides of the plate, and a second group of cutouts which are closed at only one end thereof, i.e., in the vicinity of the edge at one side of the plate from which they extend, an end opposite to the closed end of the cutout terminating in one of the edges of the plate which are perpendicular to the edges of the plate from whose vicinities the cutouts originate, thereby forming gaps in the perpendicular edges. Alternatively, and if each of the two plates additionally comprises two longitudinal cutouts which extend parallel to, and in the vicinities of, edges at perpendicular sides of a plate and both of these cutouts have one closed end and one end merging into a collector hole located in the vicinity of the closest corner of the plate, the second group of cutouts merges into one of the longitudinal cutouts which extend parallel to the perpendicular sides instead of merging into one of the edges of the perpendicular sides. The two plates of the plate pack may be identical or may differ with respect to at least one of the plate thicknesses, the number of cutouts in the plate, the width of the cutouts, the distance between the cutouts, the configuration of the cutouts, and the inclination of the cutouts. Further, one of the first and second plates with cutouts is rotated by 180° around a central symmetry axis which is parallel to the sides of the first and second plates at which the cutouts are closed or, in the case of plates with longitudinal cutouts merging into a collector hole, rotated by 180° around a central symmetry axis of the first and second plates which is parallel to the sides with longitudinal cutouts, resulting in at least some of the cutouts of the first plate intersecting at least some of the cutouts of the second plate. For example, a total of at least five cutouts in one plate may be intersected by a total of at least five cutouts in the other plate.

BRIEF DESCRIPTION OF THE DRAWINGS

Embodiments of the invention are described hereinafter with reference to the accompanying drawings. Neither the description nor the drawings should be understood as restricting in any way the scope of the invention. In the drawings.

DETAILED DESCRIPTION OF EXEMPLARY EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description in combination with the drawings making apparent to those of skill in the art how the several forms of the present invention may be embodied in practice.

The embodiment of the heat exchanger of the invention described herein comprises an assembly of rectangular flat plates, connected to each other by e.g., diffusion welding and/or soldering, in which adjacent flat plates (Ps) with longitudinal cutouts (FIG. 3A and FIG. 3B, FIG. 4A, FIG. 4B and FIG. 4C) alternate with a solid plate (S) in such a way that a pair of adjacent flat plates Ps with cutouts (a plate pack Ps*) (FIG. 5, FIG. 6) or flat plates P1*s* with cutouts and collector holes (FIG. 5B) is placed between two solid plates (S), forming an inter-plate channel (C) for the passage of a medium (FIG. 3A, FIG. 3B, FIG. 6, FIG. 7). Depending on the operating conditions, the heat exchanger can be made of plates Ps with external collectors or plates P1*s* with internal collectors (including collector holes).

Figure 1:
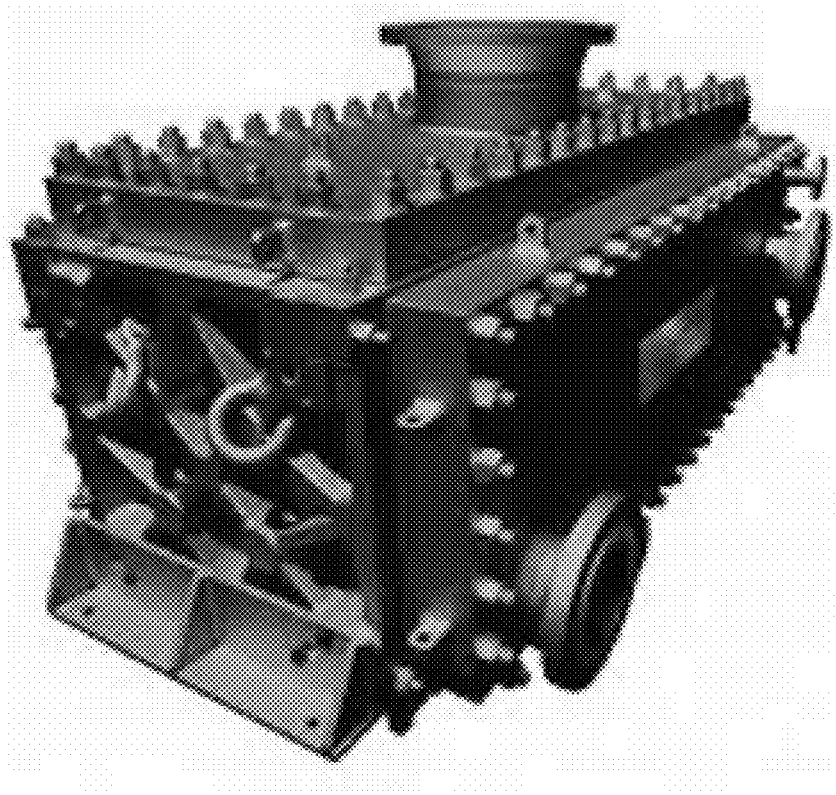
FIG. 1 shows a welded plate heat exchanger with a power housing.
Figure 2:
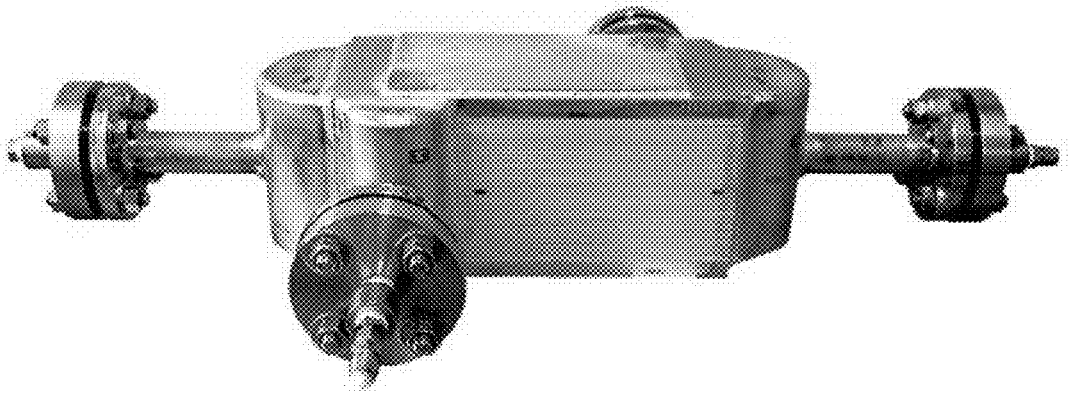
FIG. 2 shows a welded plate heat exchanger with collectors welded directly to the plate assembly.
Figure 3A:
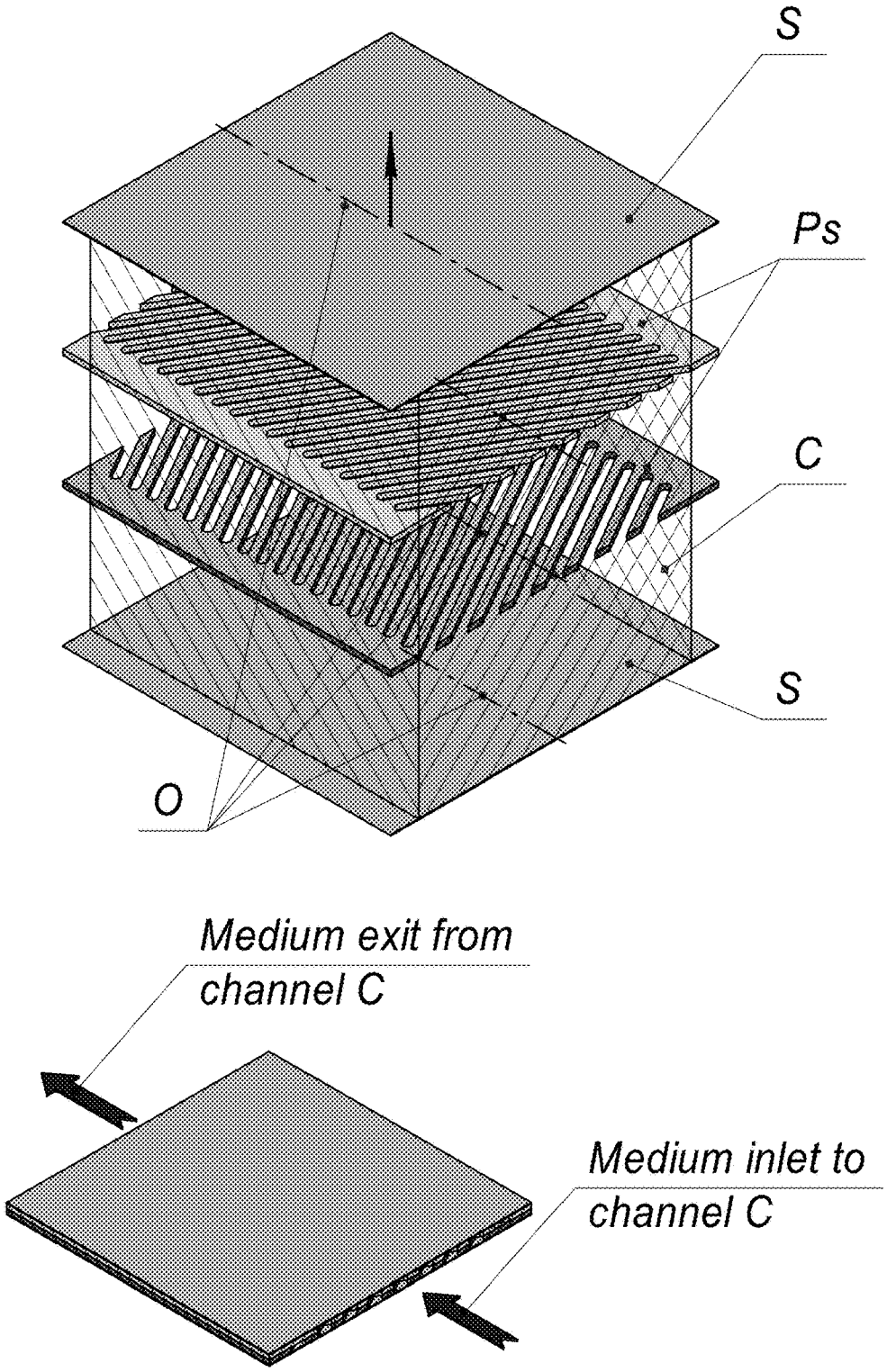
FIG. 3A schematically shows a first embodiment of a plate unit of a heat exchanger of the invention.
Figure 3B:
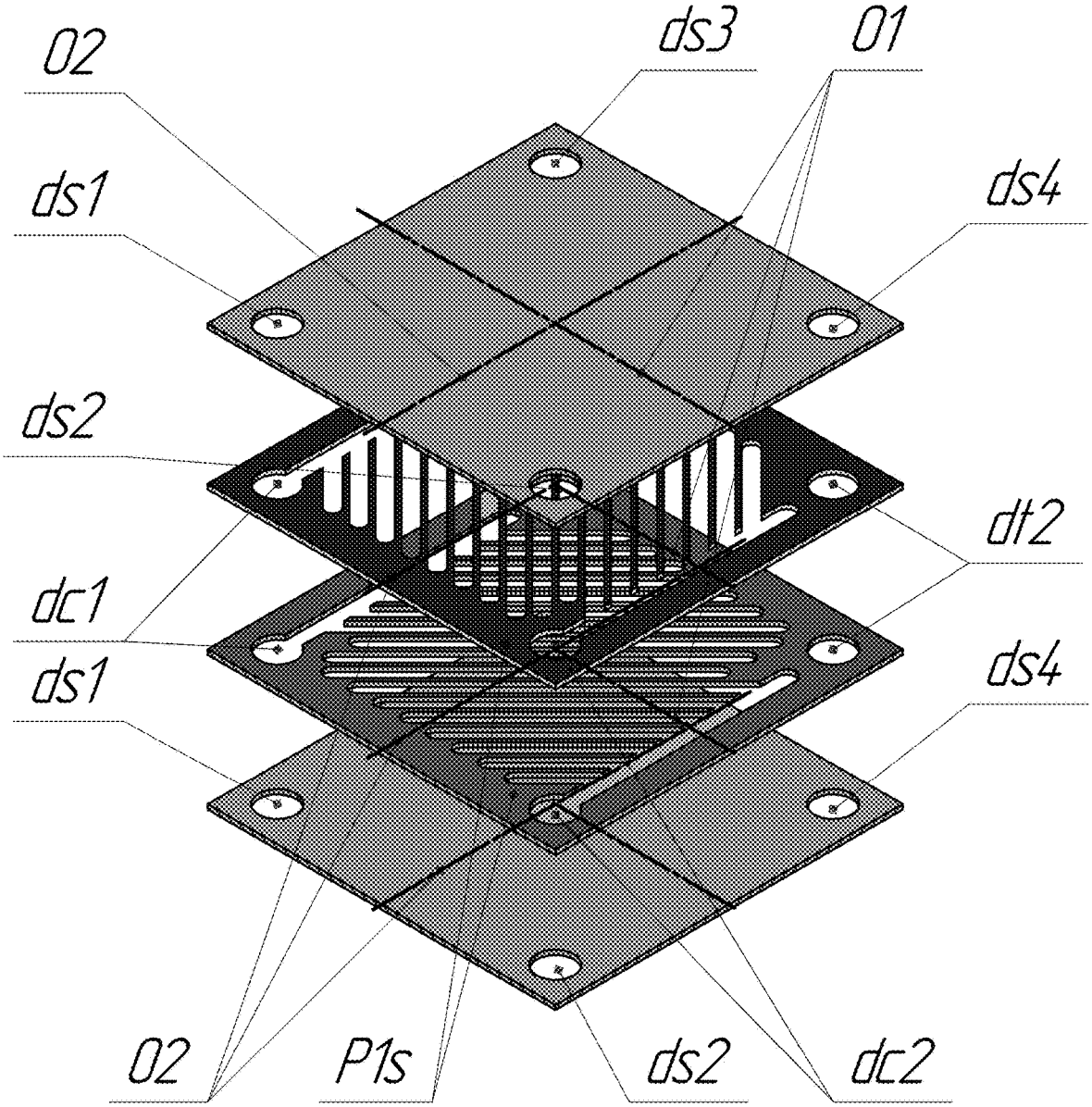
FIG. 3B schematically shows a second embodiment of a plate unit of a heat exchanger of the invention.
Figure 4A:
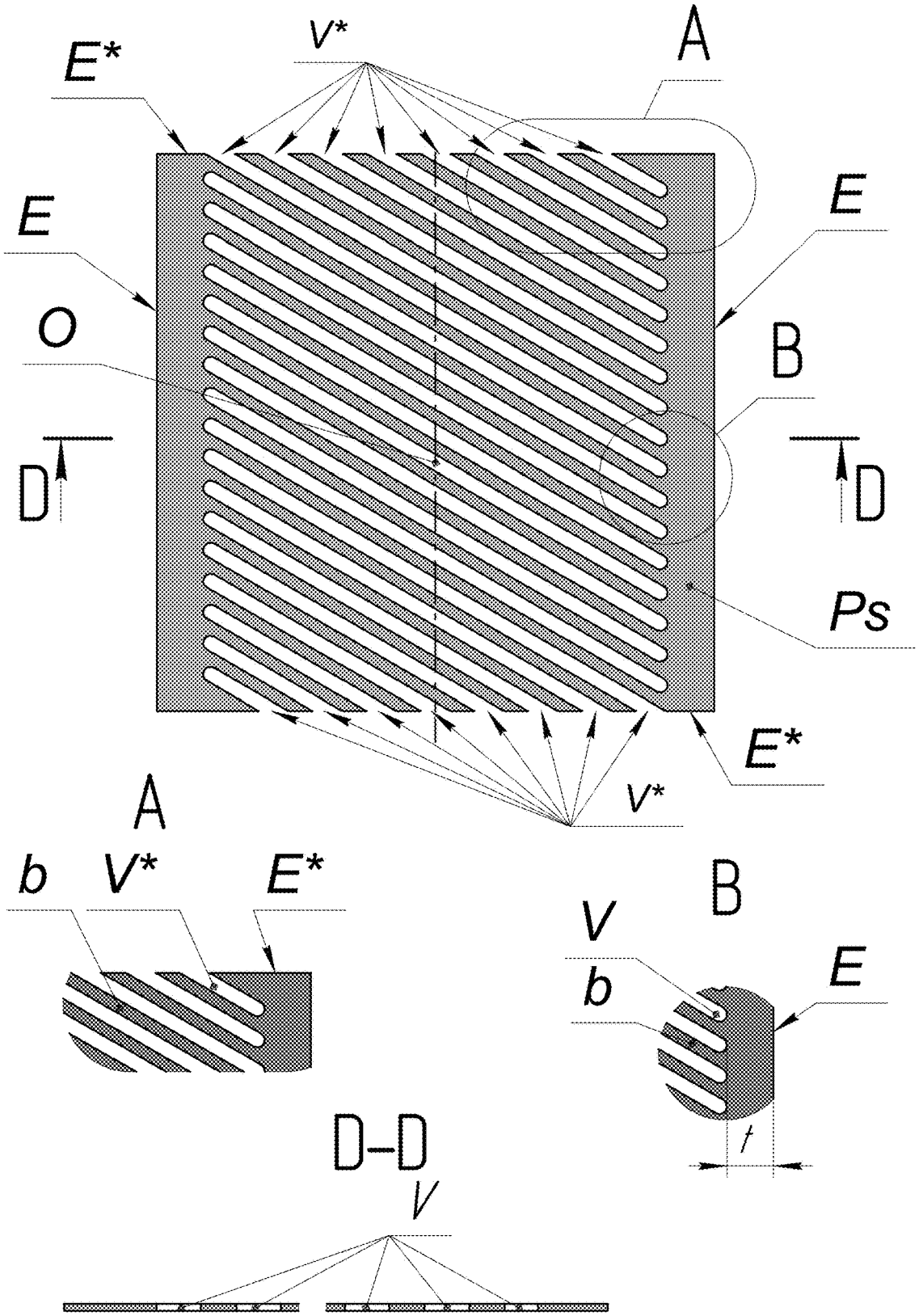
FIG. 4A schematically shows a plate of a plate pack of the first embodiment of a plate unit of the heat exchanger of FIG. 3A.
Figure 4B:
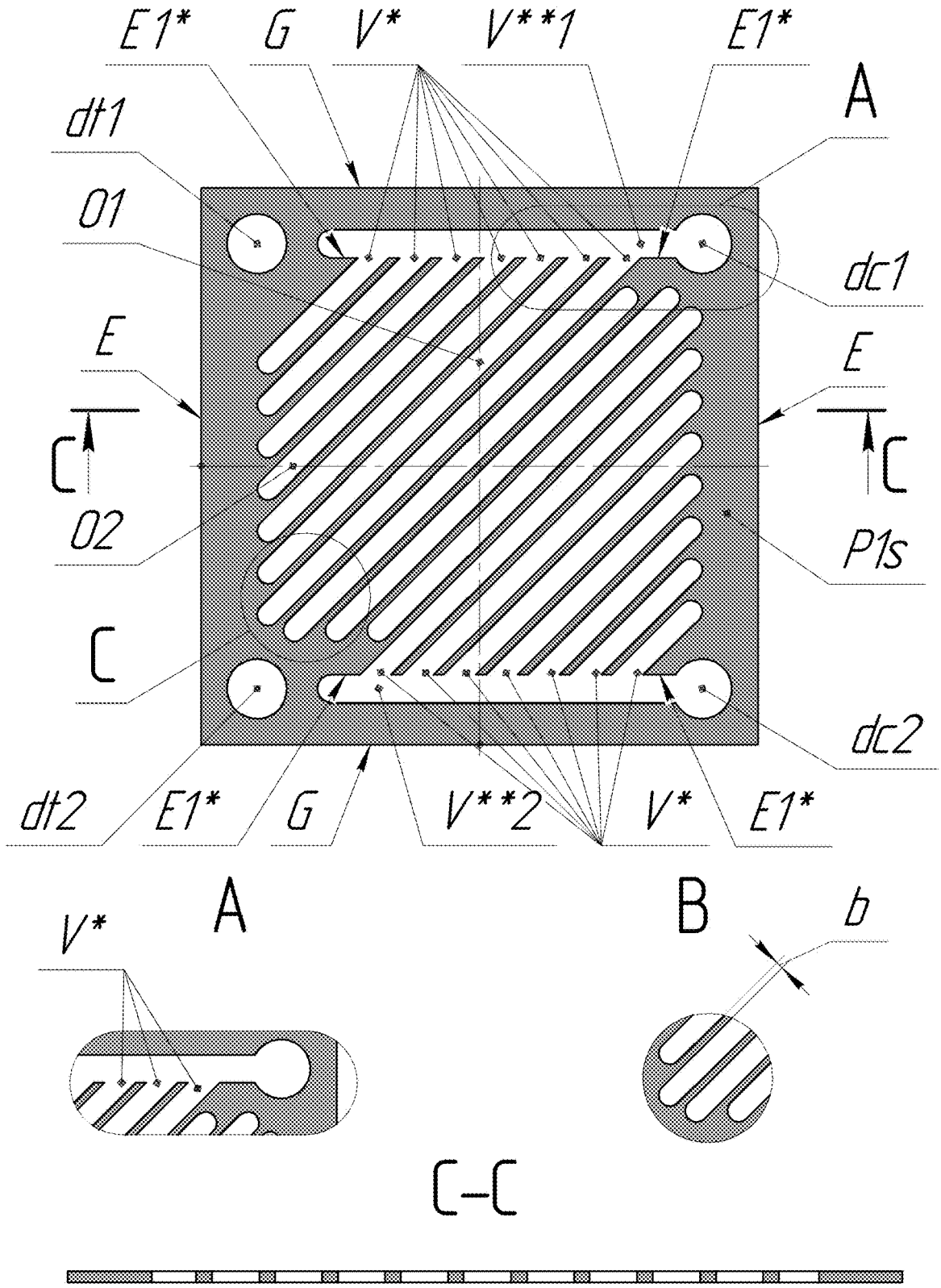
FIG. 4B schematically shows a plate of a plate pack of the second embodiment of a plate unit of the heat exchanger of FIG. 3B (with the collector holes for the longitudinal cutouts on the same side of the plate).
Figure 4C:
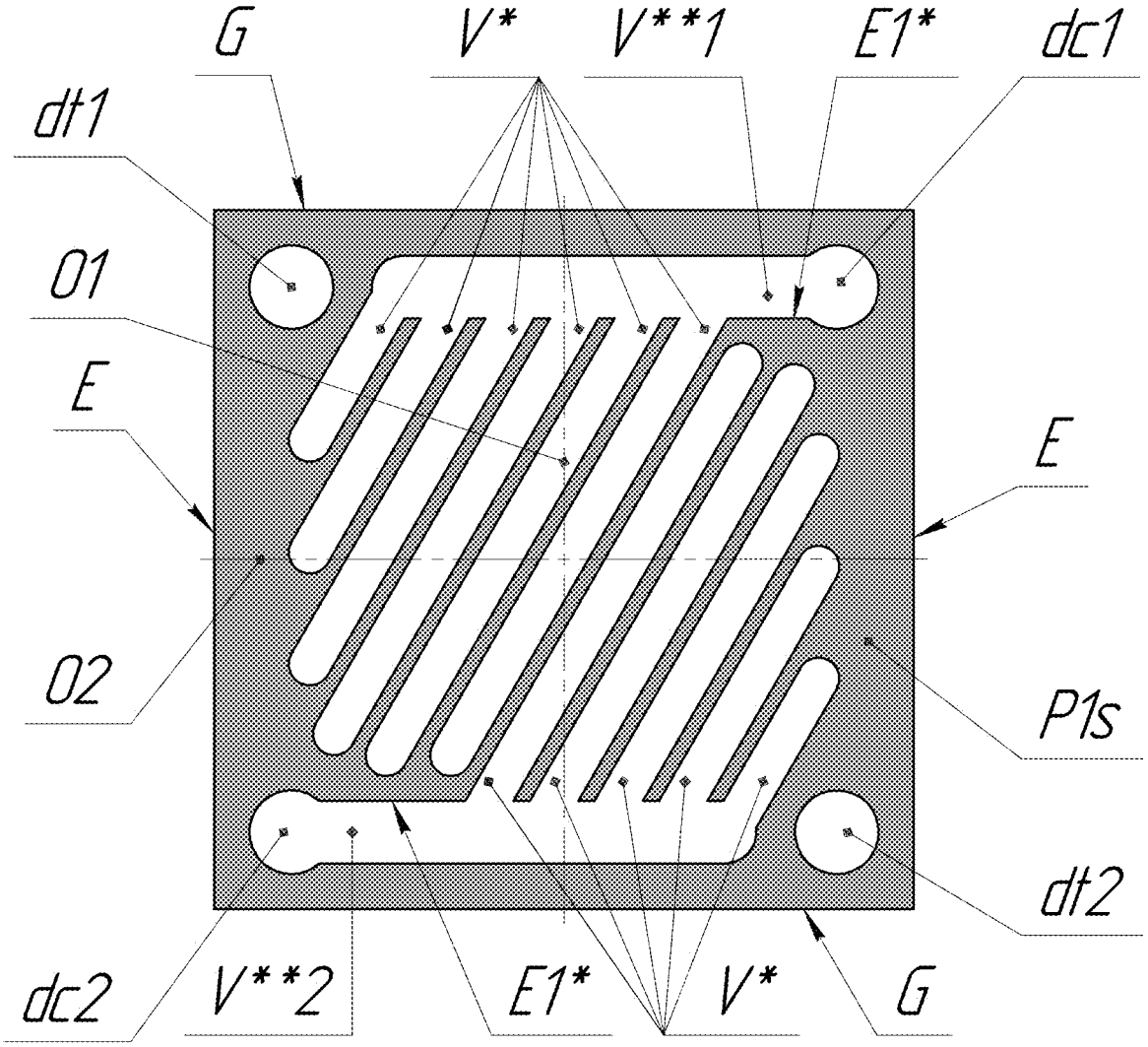
FIG. 4C schematically shows another plate of a plate pack of the second embodiment of a plate unit of a heat exchanger similar to the heat exchanger of FIG. B (with the collector holes for the longitudinal cutouts diagonally spaced on opposite sides of the plate).

The longitudinal cutouts on two adjacent plates (Ps) or (P1*s*) are divided into two groups (FIG. 4A, FIG. 4B, FIG. 4C).

The first group of longitudinal cutouts (V in FIG. 4A) is closed at both ends thereof at both sides of a plate (Ps) or (P1*s*) at some distance (t) from the lateral opposite edges (E) of the plate (circle B in FIG. 4A). The second group of cutouts (V* in FIG. 4A) is closed only on one side of their length at some distance (t) from the lateral opposite edges (E) of the plate, while the second end of the longitudinal cutout (V*) terminates freely at one of the perpendicular lateral edges (E*) of the same plate (circle A in FIG. 4A) or—in another variant (with internal collectors V**1 and V**2 with holes dc1 and dc2 shown in FIG. 4B, located parallel to the axis O at the ends of plates P1*s*)—ends at the edges of the internal collectors (at E1*) (circle A in FIG. 4B).

Figure 5A:
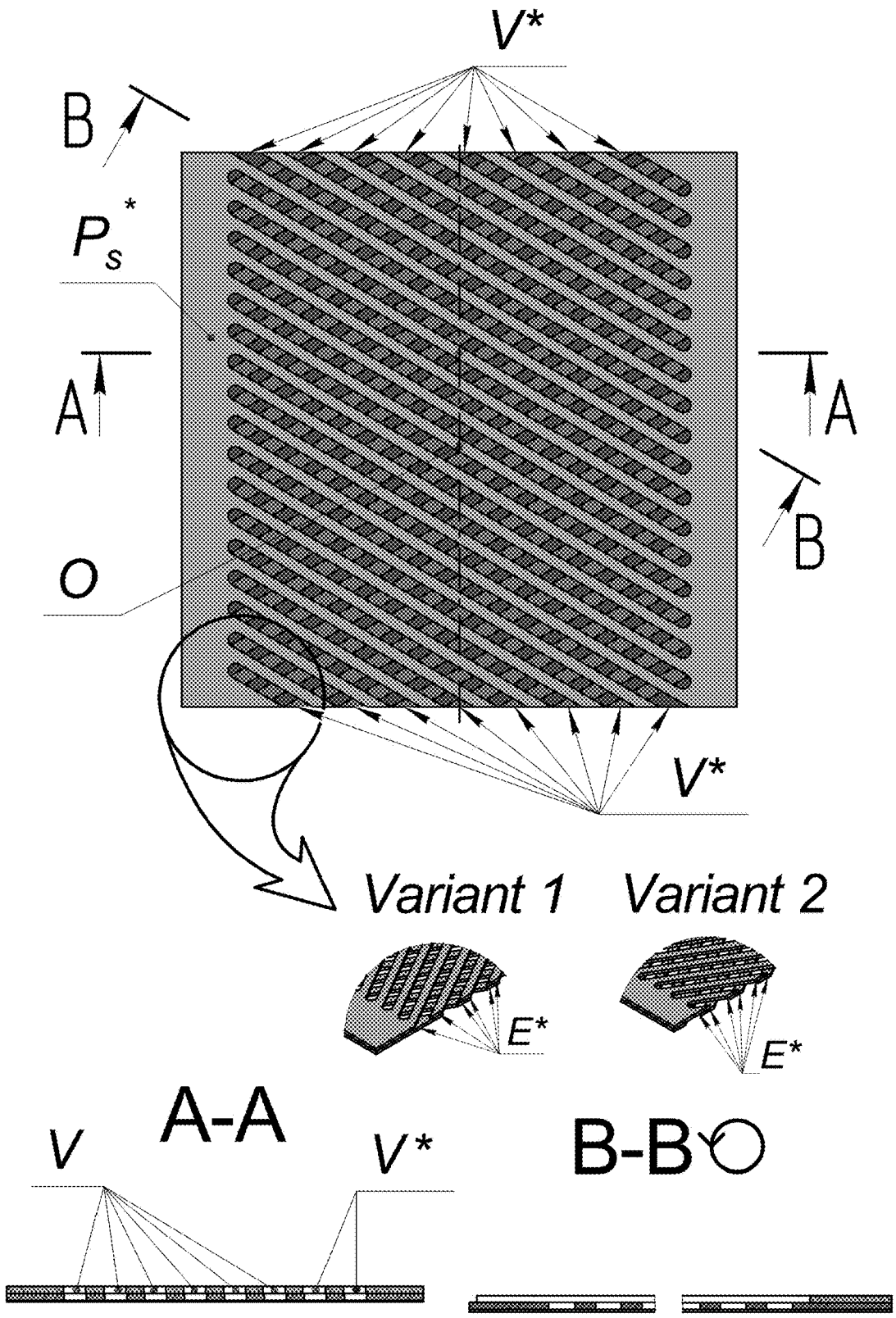
FIG. 5A schematically shows a plate pack of the first embodiment of a plate unit of the heat exchanger of FIG. 3A.
Figure 5B:
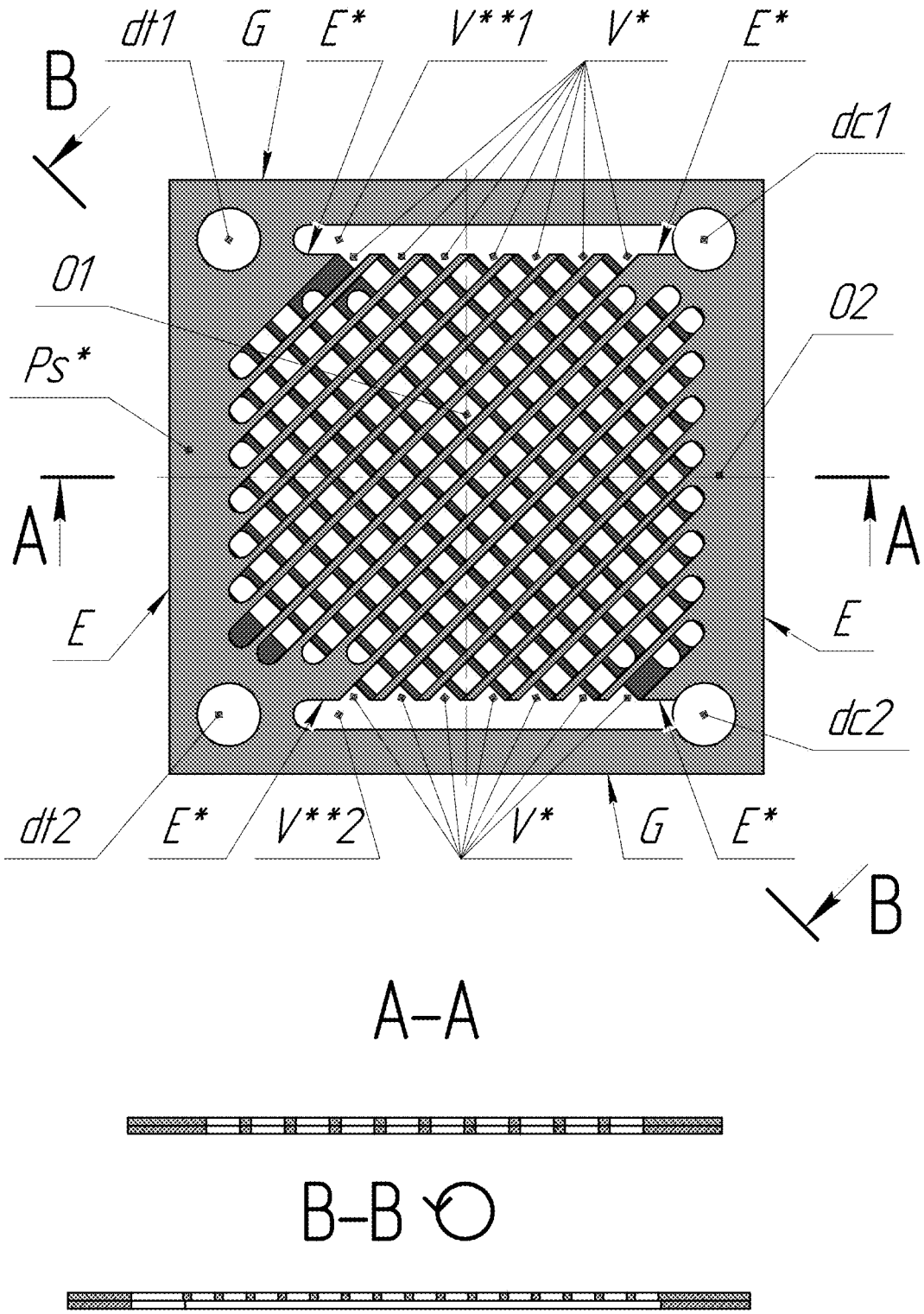
FIG. 5B schematically shows a plate pack of the second embodiment of a plate unit of the heat exchanger of FIG. 3B.
Figure 6A:
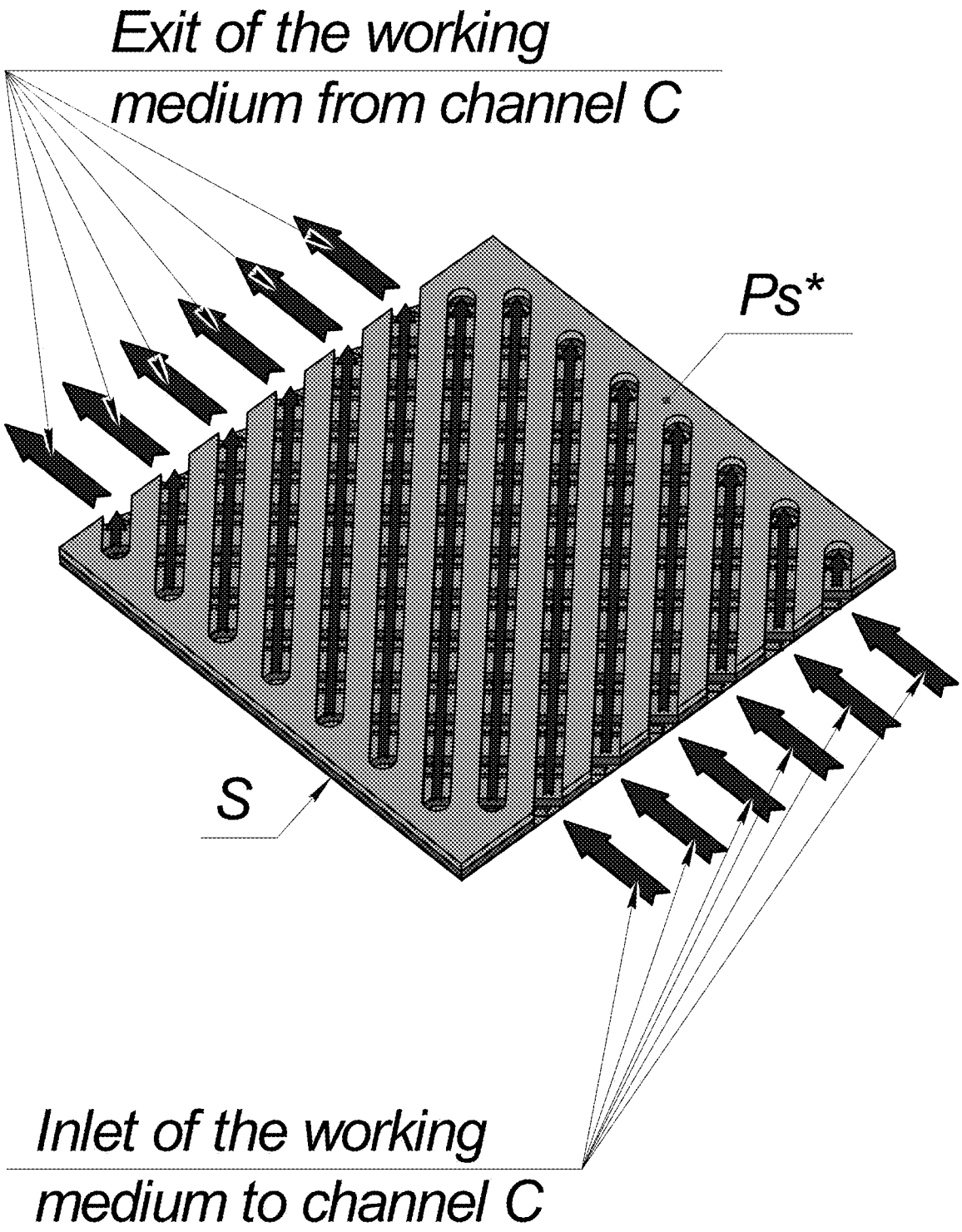
FIG. 6A schematically shows a first embodiment of a unit of the heat exchanger of the invention.
Figure 6B:
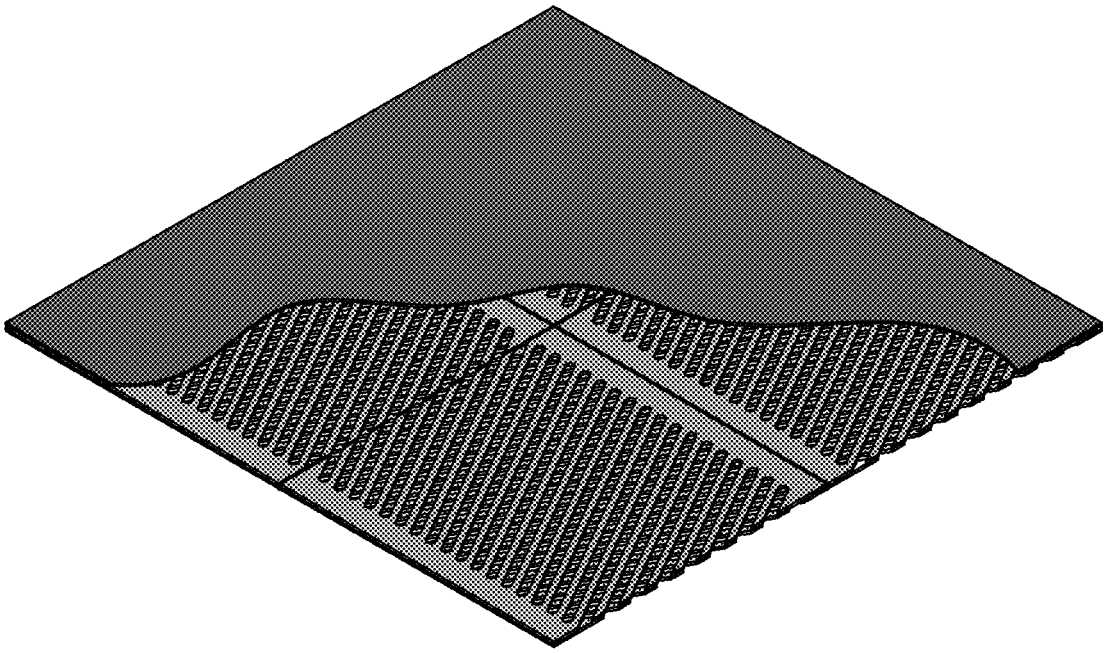
FIG. 6B schematically shows a second embodiment of a unit of the heat exchanger of the invention wherein the plate pack consists of several smaller abutting plate packs.

The cutouts (V) and (V*) of adjacent plates (Ps) or (P1*s*) are positioned in such a way that when one plate (Ps) is rotated relative to the adjacent plate by 180 degrees around the longitudinal axis (O) (FIG. 4A) or one plate (P1*s*) is rotated relative to the adjacent plate by 180 degrees around the axis (O2) (FIG. 4B and FIG. 4C) with their subsequent alignment along the contour, cutouts (V) and cutouts (V*) in adjacent plates (Ps) intersect each other (FIG. 3A, FIG. 3B, FIG. 4A, FIG. 4B, FIG. 5A, FIG. 5B, FIG. 6, FIG. 7A, FIG. 7B) to form channels (C) with a varying cross-section for the passage of the medium in a plate pack (Ps*) that is sandwiched between two flat plates (S) (section B-B, FIG. 5).

Figure 7A:
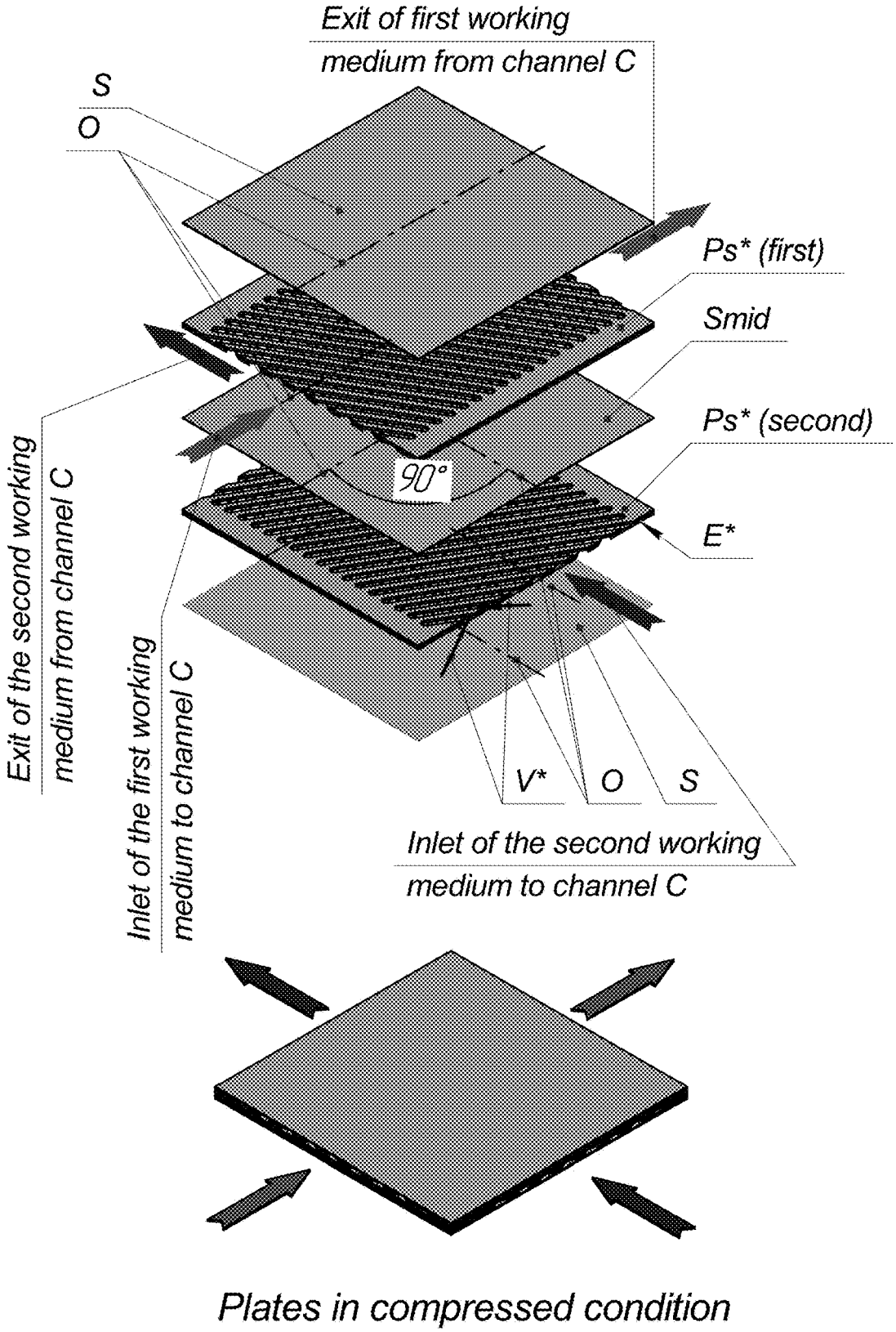
FIG. 7A schematically shows a third embodiment of a plate unit of a heat exchanger of the invention.
Figure 7B:
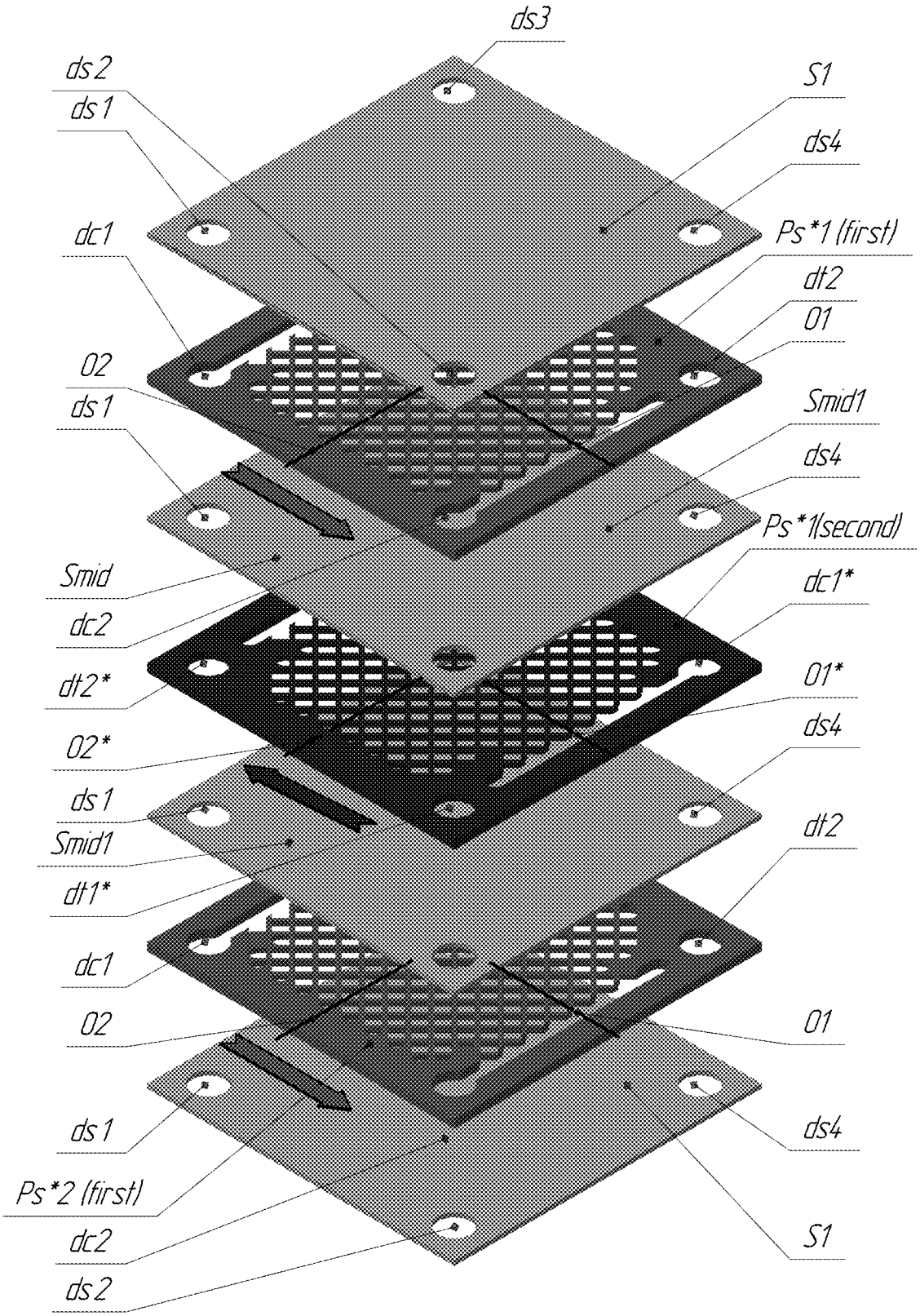
FIG. 7B schematically shows a fourth embodiment of a plate unit of a heat exchanger of the invention (plate pack with longitudinal cutouts).
Figure 8:
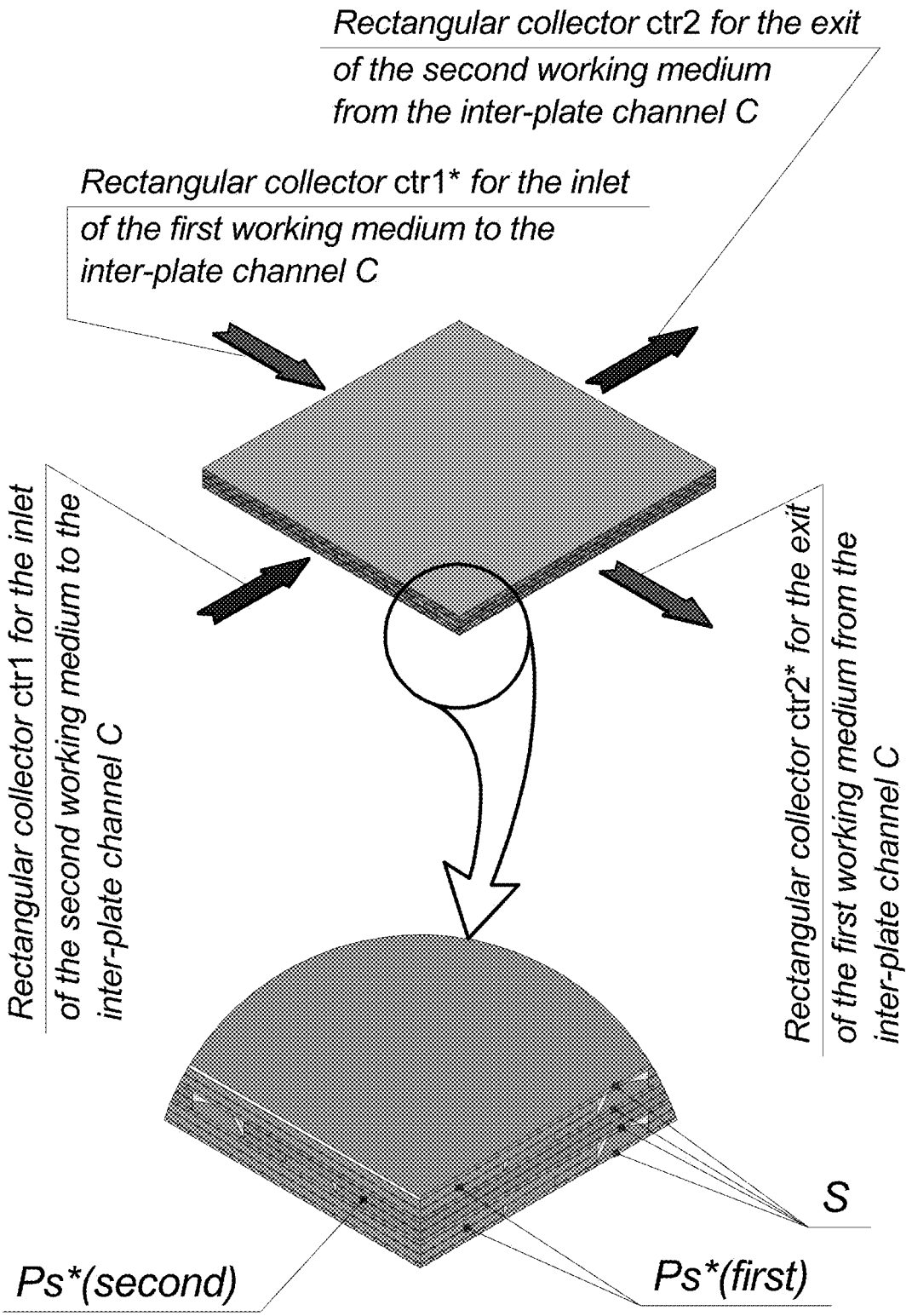
FIG. 8 schematically shows several of the first embodiments of a plate unit of a heat exchanger of the invention shown in FIG. 7A in an assembled state.

After rotation around the axis (O) by 180 degrees the ends of the half-closed cutouts (V*) in a plate pack (Ps*) at the exit to the edge (E*) are aligned or not aligned, creating the cross-section for the passage of the working media (FIG. 5A, Variant 1 or Variant 2). When a plate pack (Ps*) is placed between two solid plates (S) (FIG. 3A, FIG. 3B, FIG. 6, FIG. 7), the intersecting cutouts (V) and (V*) in the plate pack (Ps*) form an inter-plate channel (C) between the solid plates (S) for the passage of the working media. In the case of an assembly with three solid plates (S)-(Smid1)-(S) (FIG. 7A) a first plate pack (Ps*) installed between upper solid plate (S) and (Smid1) forms a first channel (C); a second plate pack (Ps*) is also installed between the opposite side of solid plate (Smid1) and lower solid plate (S). However, the axis (O) of this second plate pack (Ps*) is oriented perpendicular to the axis (O) of the first plate pack (Ps*) with the opposite upper surface of the solid plate (Smid1) (FIG. 7A). The ends of the longitudinal cutouts (V*) extending to the side edges (E*) of the plate pack (Ps*) form rectangular collector openings for the passage of the working medium to the channel (C) between the solid plates (S) together (FIG. 8). Each solid plate (S) with its two principal surfaces participates in the formation of two adjacent inter-plate channels (C) with the adjacent solid plates (S) with the formation for each channel of two rectangular collector holes (ctr1) and (ctr2) located on opposite edges of the plate for the entrance and exit from the channel of the working medium. On the opposite side of the solid plate (S), rectangular collector holes (ctr*1) and (ctr*2) are arranged on opposite edges of the plate S perpendicular to the collector holes (ctr1) and (ctr2). In this way, the two working media are in contact with the two planes (main surfaces) of the plate (S), enabling heat transfer.

Figure 9:
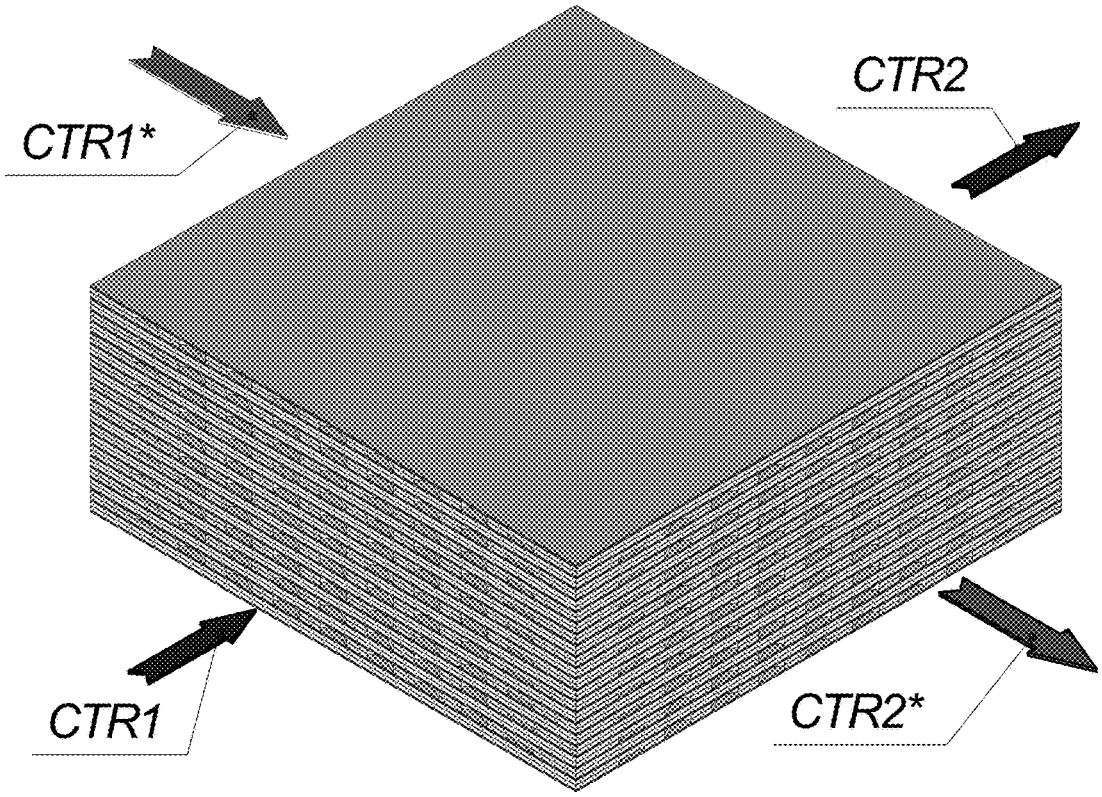
FIG. 9 schematically shows several of the first embodiments of a plate unit of a heat exchanger of the invention shown in FIG. 7A in an assembled state.

Due to the described design of adjacent channels on both sides of the solid plate (S), the plate package has a system of two channels for the passage of two working media: the first system of channels from two opposite sides of the package (CTR1) and (CTR2), the second system from the other two sides of the package at the ends of the plates (CTR*1) and (CTR*2) (FIG. 9).

In another variant (with internal collectors), plates with cutouts (P1*s*) have two axes O1 and O2 and as in the first variant have longitudinal cutouts (V), and (V*) along the axis O1, which, when combining two adjacent plates (by rotating one of the plates by 180 degrees around the axis O2), intersect each other and, being between solid plates, form channels of various variable cross-sections for the passage of the medium (section B-B in FIG. 5B). The ends of the half-closed cutout channels (V*) of adjacent plates (P1*s*) at the exit to the edges (E1*) of longitudinal cutouts (V**1 and V**2) parallel to the axis O2 form quadrangular holes for the passage of the medium into the inter-plate channel formed by a pair of adjacent plates (P*1) located between the solid plates (S1). The longitudinal cutouts (V**1 and V**2) are located at some distance from the edges (G) and merge into circular holes (dc1) and (dc2), which are located at some distance from the edge of the plate (E). At opposite corners of the plates are circular holes (dt1) and (dt2) at some distance from the end of the longitudinal cutout (V). All holes (dc) and (dt) of the plate are symmetrically located with respect to the plate symmetry axes and, respectively, in the solid plate (S1) the holes ds1, ds2, ds3, ds4 are also symmetrically located, coinciding with the location of holes dc and dt (FIG. 4**A).

In the case of a plate assembly with four solid plates S1-(Smid1)-(Smid1)-S1 (FIG. 7B), the installed first plate pack Ps*1 between the solid plates (Smid1) forms a first channel C. Between the back surface of solid plate (Smid1) and the second solid plate (Smid1) a second plate pack Ps*1 is rotated by 180 degrees around the axis O1 relative to the first plate pack Ps*1. The axis O1 of this (second) plate pack is parallel to the axis O1 of the first plate pack Ps*1. The open ends of the longitudinal cutouts (V*) of the second plate pack Ps*1 extend to the edges E*1 of the cutouts V**1 and V**2, parallel to the axis O2, which form longitudinal manifold openings merging with openings del and dc2 for inlet and outlet of the second medium into the channel (C). The ends of cutouts V**1 and V**2 on the opposite side of holes dc1 and dc2 are at some distance from the holes dt1 and dt2. The centers of the circular holes dt1 and dt2 and the circular holes dc1 and dc2 of the plate P1*s* integrated into the cutouts V**1 and V**2 are symmetric with respect to the axes of symmetry of the plate. Holes dc1 and dc2 of a first plate pack Ps*1 are in tight contact with holes ds1 and ds2, respectively, of the solid plate S1 of the upper plate, as well as with holes ds1 and ds2 of the middle solid plate (Smid1) and are further in contact with holes dt1 and dt2 of a second plate pack Ps*1. The holes dt1 and dt2 of the second plate pack Ps*1 further are in tight contact with the holes ds1 and ds2 of the adjacent plate (Smid1). Thus, one of the working media enters the hole ds1 of the upper solid plate S1, then enters the hole dc1 of the first plate pack Ps*1, from which part of the medium flows through the longitudinal cutout (V**1), enters the inter-plate channel formed by the first plate pack Ps*1, and further enters the hole ds2 of the solid plate S1 through the longitudinal cutout (V**2) and hole dc2, and the rest of the medium passes through the hole ds1 of the solid plate (Smid1), and then also passes through the hole dt of a second plate pack Ps*1 and into the hole ds1 of the solid plate (Smid1) and then, if the heat exchanger has a plurality of inter-plate channels, enters again into the hole dc1 of a next plate pack Ps*1, whereafter the above process is repeated. If the plate assembly ends with a solid plate S1, all holes ds1, ds2, ds3, ds4 in this plate are absent and the medium does not flow further. The second working medium enters through the hole ds3 of the solid plate S1, passes through the hole dt1 of the first plate pack Ps*1, through the hole ds3 of the solid plate (Smid1) enters the hole dc1 in the longitudinal cutout (V**1) from where through the holes of cutouts V* it enters the inter-plate channel of the second plate pack Ps*1. Having passed the channel, the medium, through the longitudinal cutout (V**2) and hole dc2, enters the hole ds4 of the solid plate S1. From the hole ds4 the medium passes through the hole dt2 of the first plate pack Ps*1 and exits the opening ds4 to the solid plate S1. In case the plate assembly consists of a plurality of channels, the medium in the second channels will pass through holes dt1 and dt2 of the first channels, and the medium in the first channels will transit through holes dt1 and dt2 of the second channels.

The variable cross-sections of the inter-plate channels with sharp transitions (90 degrees between the main plane of the plate and the plate with cutouts) (FIG. 5A, section B-B) increase the turbulence of the flow of the medium, increasing the heat transfer through a solid plate.

By changing the cross-sections of channels (V) and (V*), as well as the contact areas (b) between adjacent plates (Ps) or (P1*s*), it is possible to optimize the design of the heat exchanger for a specific technological task with much lower costs compared to the use of corrugated plates, taking into account the hydrodynamic regimes of the working media, their pressures and temperatures.

Moreover, a pair of adjacent plates with cutouts can also be made from two plates of a different design of the arrangement of the cutouts. The main requirement is the intersection of at least some cutouts with each other in the plate pack (Ps*). Cutouts (V*) in a plate pack (Ps*) may not coincide on the edges of plate endings (E*) (FIG. 5, Variant 2).

The manufacture of plates (Ps) or (P1*s*) with cutouts (V) and (V*) can be performed by high-speed technologies such as laser cutting, waterjet cutting or punching with a press. This design of the plate assembly with flat plates contacting each other mainly on flat areas of a large area of the plate allows the use of more advanced methods of the welding of metals, such as diffusion welding, to obtain a connection of the plates on the planes at the molecular level, which provides high strength of the connection, equal to the strength of the material itself. This enables the provision of an efficient plate heat exchanger which is suitable for use at high pressures and/or high temperatures. In the technological tooling the assembly of the above-described plates may be inserted into a vacuum furnace, heated to a temperature of e.g., 0.5 to 0.7 from the melting point of the metal and at the moment of melting, compressed with a certain force. After cooling, the assembly is ready for the further manufacture of the heat exchanger.

Figure 10:
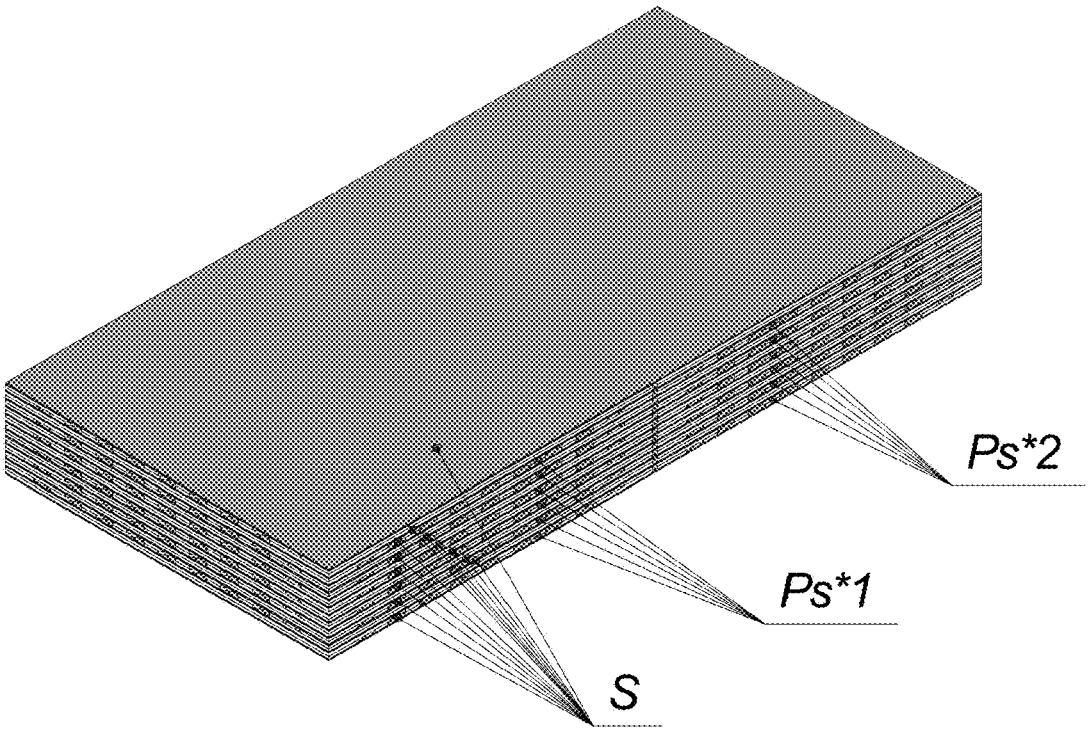
FIG. 10 schematically shows several of the first embodiments of a plate unit of a heat exchanger of the invention shown in FIG. 7A in an assembled state.

The use of diffusion welding makes it possible to manufacture PHEs from different materials depending on the aggressiveness of the employed media, as well as in one PHE unit to produce adjacent plates with cutouts (Ps) or (P1*s*) from different materials depending on their corrosion resistance to the media processed in the heat exchanger. In addition, it is possible to produce a plate assembly in which adjacent plates with cutouts (Ps) or (P1*s*) can be made of several parts while the solid plates (S) or (S1) are in one piece of the required size (FIG. 10). All these technical possibilities will additionally reduce the cost of the heat exchanger.

Figure 11:
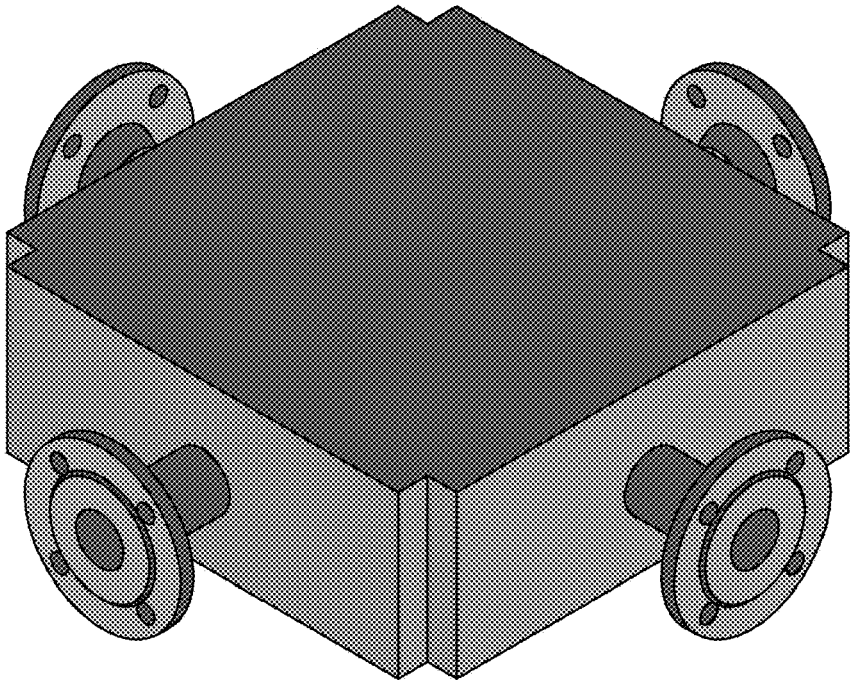
FIG. 11 schematically shows a plate heat exchanger of the invention with the second embodiment of a plate unit of a heat exchanger shown in FIG. 7A.
Figure 11:
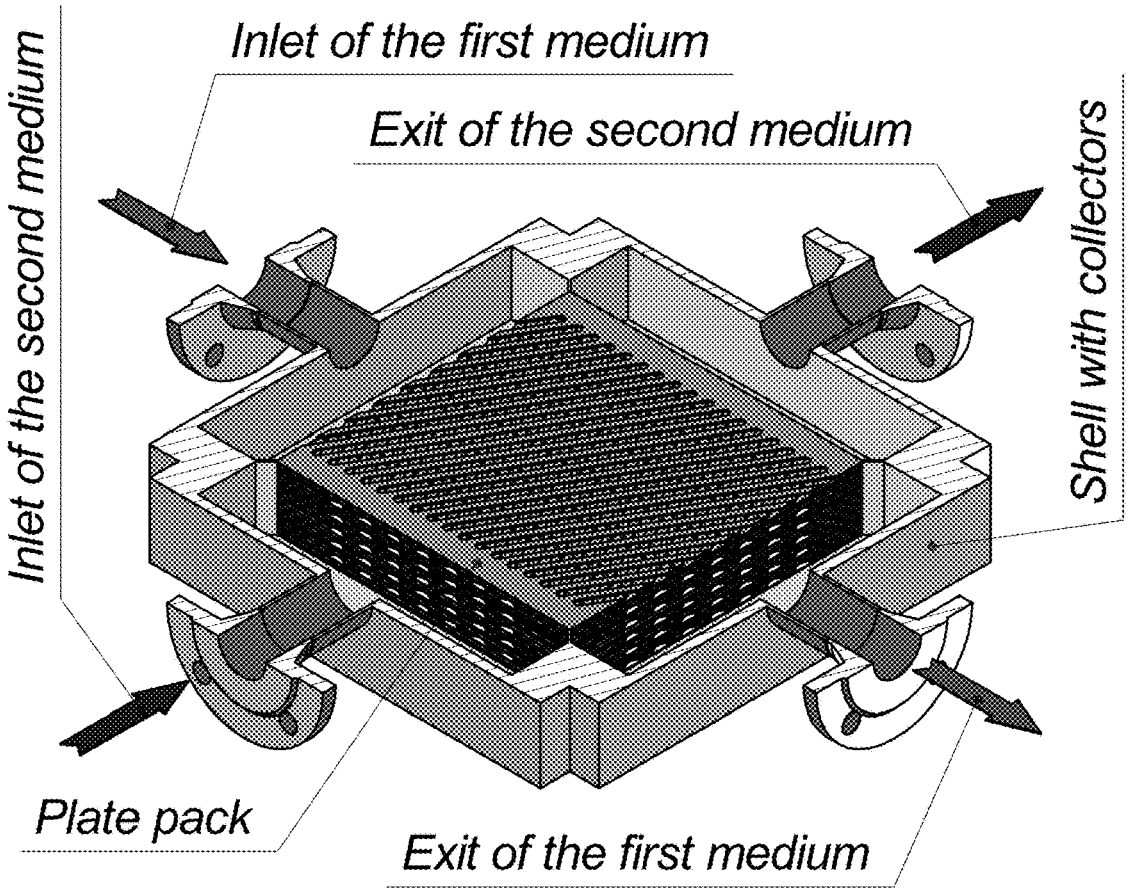
Figure 12A:
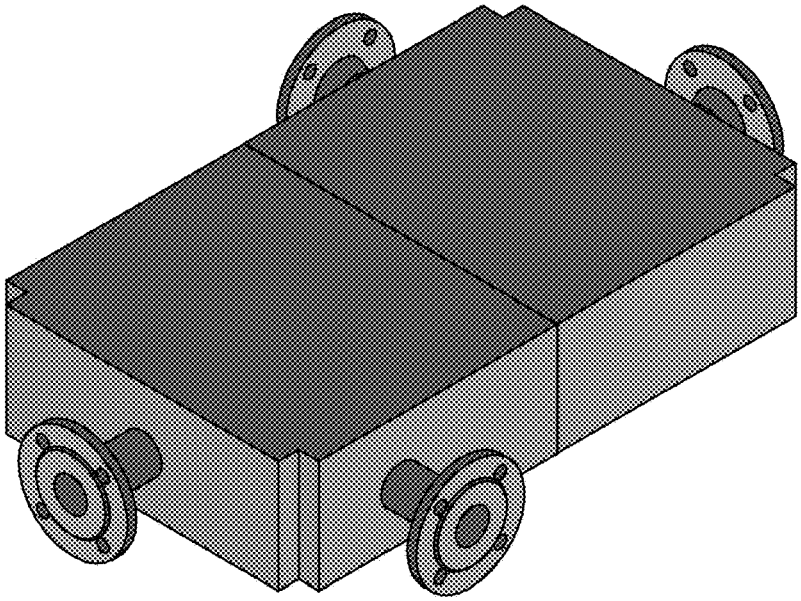
FIG. 12A schematically shows another plate heat exchanger of the invention with the second embodiment of a plate unit of a heat exchanger shown in FIG. 7A.
Figure 12A:
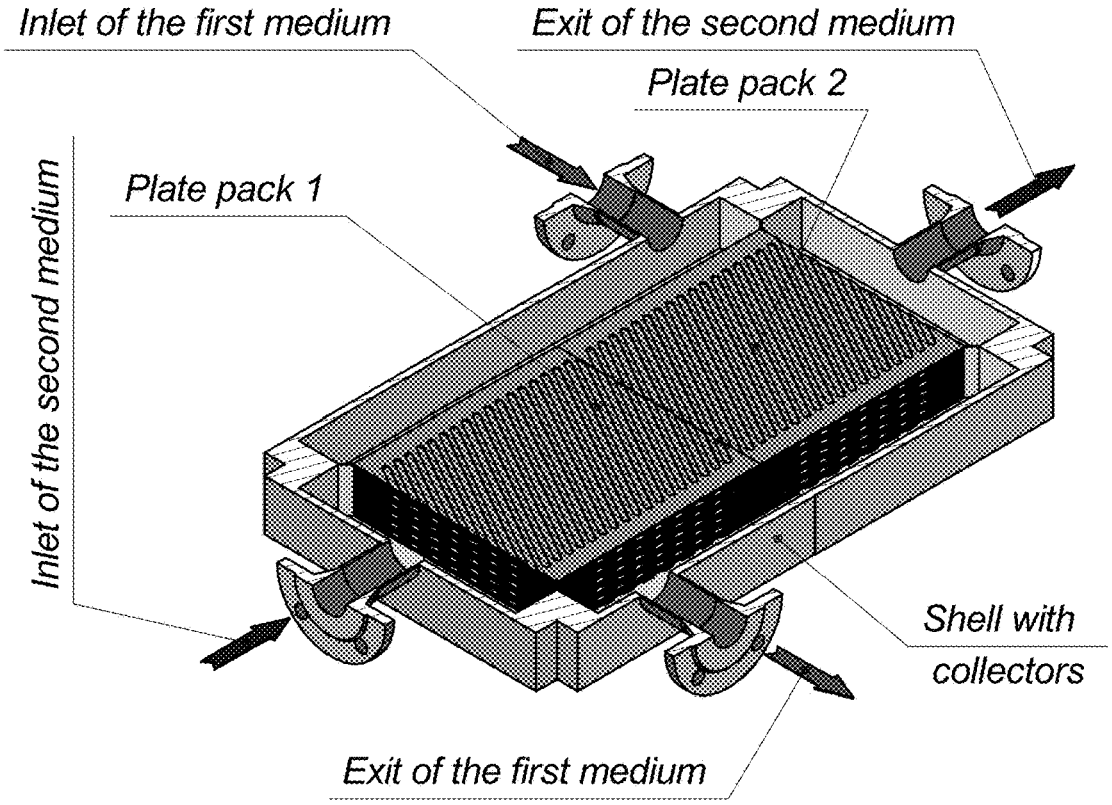
Figure 12B:
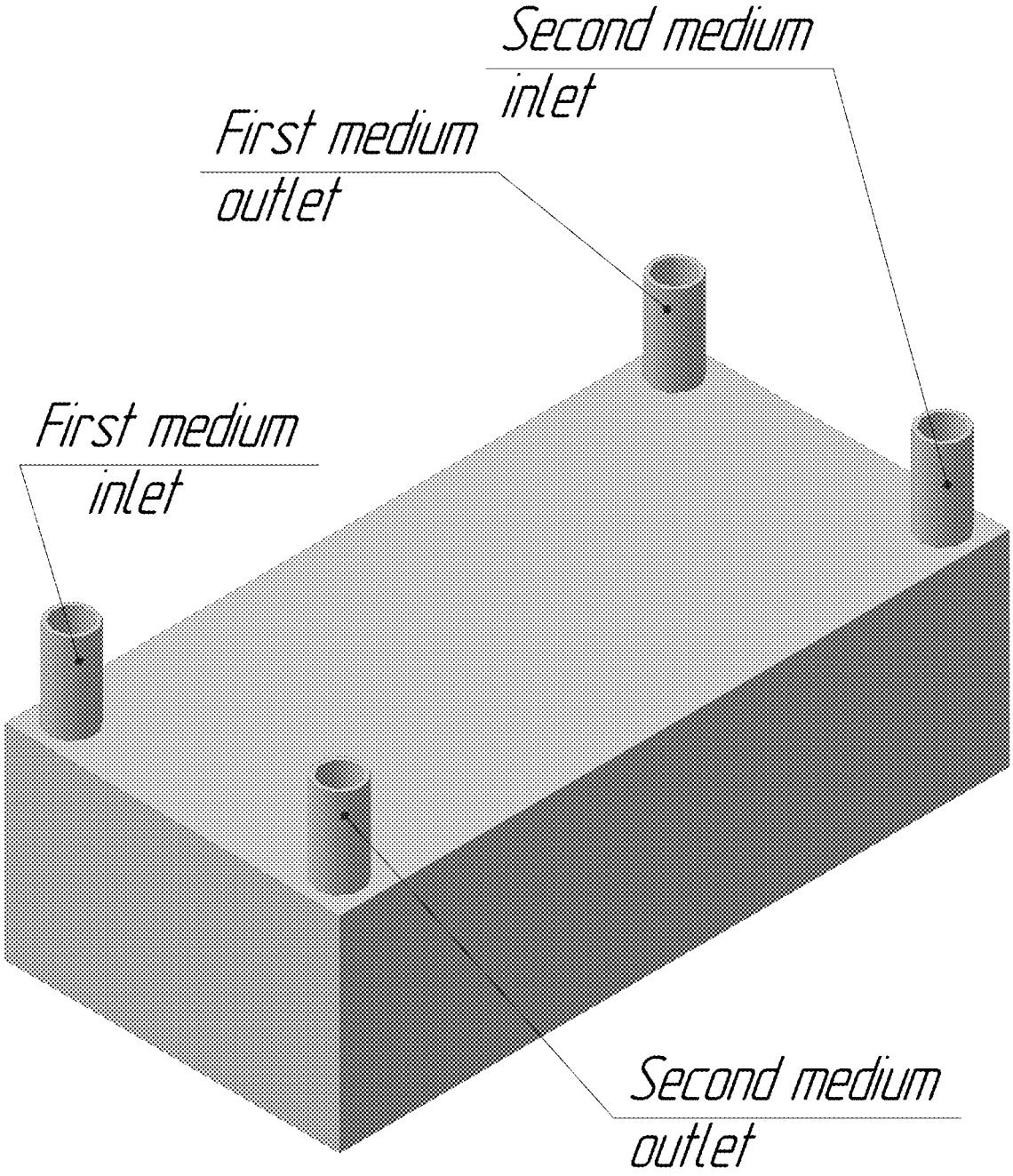
FIG. 12B schematically shows another plate heat exchanger of the invention with the second embodiment of a plate unit of a heat exchanger shown in FIG. 7B.

For manufacturing a PHE of the invention, it usually is sufficient to weld collector branch pipes to a plate assembly by conventional methods of welding (FIG. 11). In case of manufacturing a heat-exchanger of large capacity, which, as a rule, requires plates of large overall dimensions, it is possible to use several identical plate assemblies (modules), connecting them to each other in any direction (vertically or horizontally) by conventional welding methods, with the subsequent welding of collector branch pipes depending on specific technological tasks, optimizing the heat exchanger design, making it block modular (FIG. 12A). In the case of manufacturing the heat exchanger according to the second variant to the last solid plate S1 collector holes ds1, ds2, ds3, ds4 may be welded by usual welding methods (FIG. 12B)

In addition to diffusion welding, the plate assembly may also be produced by brazing with the use of effective solders. Soldering a significant contact area (b) between cutouts (V) will increase the rigidity of the heat exchanger design at high pressures of working media, and the presence of external collectors according to the first variant will significantly increase the service life due to the ability to remove contaminations in the inter-plate channels of the heat exchanger (FIG. 11).

Regarding the drawings, the following is noted:

FIG. 3A:

Ps—plates with longitudinal cutouts

S—solid plates, forming an inter-plate channel C-space between two plates S, where two plates Ps are arranged with rotation of one of the plates by 180 degrees around the axis O. The S plates are moved apart for clarity. The right image shows the same plates in working condition.

FIG. 4A:

E—side edges of the plates Ps, parallel to the axis O;

E*—a pair of side edges of plates Ps, perpendicular to the edges E;

V—cutouts closed at two sides at some distance from the side edges E of the plates Ps;

V*—cutouts closed at one side at some distance from the side edges E and free exit to the edge E* in the plate Ps;

b—distance between adjacent cutouts V and V*.

FIG. 5A:

Ps*—pair of adjacent plates Ps with one of them rotated relative to the other by 180 degrees.

Section B—B—channel section of a pair of adjacent plates Ps*;

V*—longitudinal cutouts extending to the edges E* of a pair of adjacent plates Ps*;

V—longitudinal cutouts closed on both sides.

FIG. 6:

S—solid plate;

Ps*—pair of adjacent plates with cutouts with rotation of one of the plates by 180 degrees around the axis O relative to the other plate and tightly mounted between themselves and between two solid plates S; the upper plate S is not shown for better visualization.

FIG. 7A:

two pairs of adjacent plates Ps* (first) and Ps* (second), tightly fitted together, are arranged on both sides of the middle plate (Smid) and adjacent to it on both sides of a plate S, with the axis O of the pair of adjacent plates Ps* (first) from the upper side of the plate Smid perpendicular to the axis O of the pair of adjacent plates Ps* (second) below the lower side of the plate (Smid).

To sum up, the present invention provides the following items:

1. A plate heat exchanger, wherein the heat exchanger comprises at least a first unit comprising four rectangular plates of identical outer dimensions, namely a plate pack comprising a first plate having cutouts therein and an adjacent second plate having cutouts therein, the plate pack being sandwiched between two solid plates without cutouts, the cutouts of the first and second plates extending transversely from a vicinity of an edge at one side of the first or second plate towards a vicinity of an edge at an opposite side of the plate and forming two groups of cutouts, a first group of cutouts which are closed at both ends thereof in the vicinities of the edges at opposite sides of the plate, and a second group of cutouts which are closed at one end thereof in a vicinity of an edge at one side of the plate from which they extend, an end opposite to the closed end of the cutout (i) terminating in one of the edges of the plate which are perpendicular to the edges of the plate from whose vicinities the cutouts originate, thereby forming gaps in the perpendicular edges, or (ii), if the plate additionally comprises two longitudinal cutouts which extend parallel to and in vicinities of edges at perpendicular sides of the plate and both have one closed end and one end merging into a collector hole located in a vicinity of a corner of the plate, merging into one of the longitudinal cutouts which extend parallel to the perpendicular sides, and wherein the two plates of the plate pack are identical or differ with respect to at least one of thickness of the plate, number of the cutouts, width of the cutouts, distance between the cutouts, configuration of the cutouts, and inclination of the cutouts, and wherein one of the first and second plates with cutouts is rotated by 180° around its central symmetry axis which is parallel to the edges of the sides of the plate in whose vicinity the cutouts originate, or, in the case of plates with longitudinal cutouts merging into a collector hole, is rotated by 180° around a central symmetry axis of the first and second plates which is parallel to the sides with longitudinal cutouts, resulting in at least some of the cutouts of the first plate intersecting at least some of the cutouts of the second plate.

2. The heat exchanger of item 1, wherein the heat exchanger further comprises at least a second unit which is arranged above or below the first unit and is of the same design as the first unit, also comprising a plate pack of adjacent first and second plates with intersecting cutouts sandwiched between two solid plates, the solid plate of the second unit which is adjacent to the first unit also serving as the solid plate of the first unit which is adjacent to the second unit, a plate pack of one of the first and second units, which may be the same as the plate pack of the first unit or may differ therefrom with respect to at least one of thicknesses of the first and second plates, number of the cutouts in the first and second plates, width of the cutouts in the first and second plates, distance between the cutouts in the first and second plates, configuration of the cutouts in the first and second plates, and inclination of the cutouts in the first and second plates, being rotated from a parallel orientation of the plate packs by 90° around a central axis which is perpendicular to planes of the plate packs of the first and second units.

3. The heat exchanger of item 1, wherein the heat exchanger further comprises at least two further units which are arranged above and below the first unit and are of the same design as the first unit, also comprising a plate pack of adjacent first and second plates with intersecting cutouts sandwiched between two solid plates, the solid plate of a second unit which is adjacent to and above the first unit also serving as the solid plate of the first unit which is adjacent to the second unit and the solid plate of a third unit which is adjacent to and below the first unit also serving as the solid plate of the first unit which is adjacent to the third unit, the plate packs of the second and third units, which may be the same as the plate pack of the first unit or may differ therefrom and/or from each other with respect to at least one of thicknesses of the first and second plates, number of cutouts in the first and second plates, width of cutouts in the first and second plates, distance between the cutouts in the first and second plates, configuration of the cutouts in the first and second plates, and inclination of the cutouts in the first and second plates, being rotated from a parallel orientation of all plate packs by 90° around to a central axis which is perpendicular to a plane of the plate pack of the first unit.

4. The heat exchanger of any one of items 1 to 3, wherein alternative (i) is embodied.

5. The heat exchanger of any one of items 1 to 3, wherein alternative (ii) is embodied.

6. The heat exchanger of any one of items 1 to 5, wherein the plates of the at least one unit are made of metal or a metal alloy.

7. The heat exchanger of any one of items 1 to 6, wherein all plates of the at least one unit are made of the same material.

8. The heat exchanger of any one of items 1 to 7, wherein thicknesses of the solid plates of the at least one unit may be the same or different and range from 0.5 mm to 2 mm.

9. The heat exchanger of any one of items 1 to 8, wherein a thickness of the first and second plates with cutouts is from 1 mm to 5 mm.

10. The heat exchanger of any one of items 1 to 9, wherein the two plates of the plate pack have the same thickness.

11. The heat exchanger of any one of items 1 to 10, wherein the two solid plates have the same thickness.

12. The heat exchanger of any one of items 1 to 11, wherein a thickness of the first and second plates of the plate pack is the same and/or higher than a thickness of the solid plates of a unit.

13. The heat exchanger of any one of items 1 to 12, wherein the sides of the first to fourth plates are from 50 mm to 1000 mm long.

14. The heat exchanger of any one of items 1 to 13, wherein a width of the cutouts in the first and second plates is from 3 mm to 20 mm.

15. The heat exchanger of any one of items 1 to 14, wherein all cutouts of a plate are of the same width.

16. The heat exchanger of any one of items 1 to 15, wherein an angle formed between an edge of a plate and (the main axis of) a cutout from whose vicinity the cutout originates is from 10 degrees to 75 degrees.

17. The heat exchanger of any one of items 1 to 16, wherein the cutouts of a plate are parallel to each other.

18. The heat exchanger of any one of items 1 to 17, wherein the plates are connected to each other by soldering or welding (e.g., diffusion welding).

19. A unit which is suitable for use in the heat exchanger of any one of items 1 to 18, wherein the unit comprises four rectangular plates of identical outer dimensions, namely a plate pack of a first plate having cutouts therein and an adjacent second plate having cutouts therein, the plate pack being sandwiched between two solid plates without cutouts, the cutouts of the first and second plates extending transversely from a vicinity of an edge at one side of the first or second plate towards a vicinity of an edge at an opposite side of the plate and forming two groups of cutouts, a first group of cutouts which are closed at both ends thereof in the vicinities of the edges at opposite sides of the plate, and a second group of cutouts which are closed at one end thereof in a vicinity of an edge at one side of the plate from which they extend, an end opposite to the closed end of the cutout (i) terminating in one of the edges of the plate which are perpendicular to the edges of the plate from whose vicinities the cutouts originate, thereby forming gaps in the perpendicular edges, or (ii), if the plate additionally comprises two longitudinal cutouts which extend parallel to and in vicinities of edges at perpendicular sides of the plate and both have one closed end and one end merging into a collector hole located in a vicinity of a corner of the plate, merging into one of the longitudinal cutouts which extend parallel to the perpendicular sides, and wherein the two plates of the plate pack are identical or differ with respect to at least one of thickness of the plate, number of the cutouts, width of the cutouts, distance between the cutouts, configuration of the cutouts, and inclination of the cutouts, and wherein one of the first and second plates with cutouts is rotated by 180° around its central symmetry axis which is parallel to the edges of the sides of the plate in whose vicinity the cutouts originate or, in the case of plates with longitudinal cutouts merging into a collector hole, is rotated by 180° around a central symmetry axis of the first and second plates which is parallel to the sides with longitudinal cutouts, resulting in at least some of the cutouts of the first plate intersecting at least some of the cutouts of the second plate.

20. A plate pack which is suitable for use in the heat exchanger unit of claim 19, wherein the plate pack comprises a first rectangular plate having cutouts therein and an adjacent second rectangular plate having cutouts therein, the cutouts of the first and second plates extending transversely from a vicinity of an edge at one side of the first or second plate towards a vicinity of an edge at an opposite side of the plate and forming two groups of cutouts, a first group of cutouts which are closed at both ends thereof in the vicinities of the edges at opposite sides of the plate, and a second group of cutouts which are closed at one end thereof in a vicinity of an edge at one side of the plate from which they extend, an end opposite to the closed end of the cutout (i) terminating in one of the edges of the plate which are perpendicular to the edges of the plate from whose vicinities the cutouts originate, thereby forming gaps in the perpendicular edges, or (ii), if the plate additionally comprises two longitudinal cutouts which extend parallel to and in vicinities of edges at perpendicular sides of the plate and both have one closed end and one end merging into a collector hole located in a vicinity of a corner of the plate, merging into one of the longitudinal cutouts which extend parallel to the perpendicular sides, and wherein the two plates of the plate pack are identical or differ with respect to at least one of thickness of the plate, number of the cutouts, width of the cutouts, distance between the cutouts, configuration of the cutouts, and inclination of the cutouts, and wherein one of the first and second plates is rotated by 180° around its central symmetry axis which is parallel to the edges of the sides of the plate in whose vicinity the cutouts originate or, in the case of plates with longitudinal cutouts merging into a collector hole, is rotated by 180° around a central symmetry axis of the first and second plates which is parallel to the sides with longitudinal cutouts, resulting in at least some of the cutouts of the first plate intersecting at least some of the cutouts of the second plate.

21. The plate pack of item 20, wherein the cutouts in a plate are rectilinear, curvilinear and/or broken.

22. The plate pack of any one of items 20 and 21, wherein the plate pack consists of two or more smaller abutting plate packs.

What is claimed is:

1. A plate heat exchanger, wherein the heat exchanger is configured for enabling a heat exchange between two fluids and comprises at least a first unit comprising four rectangular plates of identical outer dimensions, namely a plate pack comprising a first plate having non-intersecting cutouts therein and an adjacent second plate having non-intersecting cutouts therein, the non-intersecting cutouts of the first and second plates extending transversely from a vicinity of an edge at one side of the first or second plate towards a vicinity of an edge at an opposite side of the plate, the first and second plates both additionally comprising two longitudinal collector cutouts which extend parallel to, and in proximity of plate edges which are perpendicular to edges from which the non-intersecting cutouts originate, each longitudinal collector cutout merging into a collector hole at a corner of the respective plate, the plate pack being sandwiched between two collector plates without non-intersecting cutouts and longitudinal collector cutouts but with a collector hole at each of its four corners, two of the collector holes being located above or below the two collector holes of a first or second plate of the plate pack, the non-intersecting cutouts of the first and second plates forming two groups of cutouts, namely (i) a first group of cutouts which are closed at both ends thereof in vicinities of the edges at opposite sides of the plate, and (ii) a second group of cutouts having one end that is closed in a vicinity of an edge at a side of the plate from which the cutout extends, the other end merging into one of the longitudinal collector cutouts of the plate, thereby forming gaps in a longitudinal collector cutout, and wherein the two plates of the plate pack are identical or differ with respect to at least one of thickness of the plate, number of cutouts, width of cutouts, distance between cutouts, configuration of cutouts, and inclination of cutouts, one of the first and second plates being rotated from a parallel orientation by 180° around a central symmetry axis of the first and second plates which is parallel to the sides along which the longitudinal collector cutouts extend, resulting in at least some of the non-intersecting cutouts of the first plate intersecting at least some of the non-intersecting cutouts of the second plate.

2. The heat exchanger of claim 1, wherein the heat exchanger further comprises at least one second unit which is arranged above or below the first unit and is of the same design as the first unit, also comprising a plate pack of adjacent first and second plates with non-intersecting cutouts sandwiched between two collector plates, the collector plate of the second unit which is adjacent to the first unit also serving as the collector plate of the first unit which is adjacent to the second unit, a plate pack of one of the first and second units, which is the same as the plate pack of the first unit or differs therefrom with respect to at least one of thicknesses of the first and second plates, number of the cutouts in the first and second plates, width of the cutouts in the first and second plates, distance between the cutouts in the first and second plates, configuration of the cutouts in the first and second plates, and inclination of the cutouts in the first and second plates, being rotated from a parallel orientation of the two plate packs with respect to the inclination of the cutouts by 180° around a central axis which is perpendicular to planes of the plate packs of the first and second units.

3. The heat exchanger of claim 1, wherein the heat exchanger further comprises at least two further units which are arranged above and below the first unit and are of the same design as the first unit, also comprising a plate pack of adjacent first and second plates with non-intersecting cutouts sandwiched between two collector plates, the collector plate of a second unit which is adjacent to and above the first unit also serving as the collector plate of the first unit which is adjacent to the second unit and the collector plate of a third unit which is adjacent to and below the first unit also serving as the collector plate of the first unit which is adjacent to the third unit, the plate packs of the second and third units, which are the same as the plate pack of the first unit or differ therefrom and/or from each other with respect to at least one of thicknesses of the first and second plates, number of cutouts in the first and second plates, width of cutouts in the first and second plates, distance between the cutouts in the first and second plates, configuration of the cutouts of the first and second solid plates, and inclination of the cutouts in the first and second plates, being rotated from a parallel orientation of all plate packs with respect to the inclination of the cutouts by 180° around to a central axis which is perpendicular to a plane of the plate pack of the first unit.

4. The heat exchanger of claim 1, wherein all plates of the at least one unit are made of metal or a metal alloy.

5. The heat exchanger of claim 1, wherein all plates of the at least one unit are made of the same material.

6. The heat exchanger of claim 1, wherein at least one of the plates of the at least one unit is made of steel, iron, nickel or chrome.

7. The heat exchanger of claim 1, wherein a thickness of the collector plates of the at least one unit is from 0.5 mm to 2 mm.

8. The heat exchanger of claim 1, wherein a thickness of the first and second plates with non-intersecting cutouts is from 1 mm to 5 mm.

9. The heat exchanger of claim 1, wherein the two plates of the plate pack have the same thickness.

10. The heat exchanger of claim 1, wherein the two collector plates have the same thickness.

11. The heat exchanger of claim 9, wherein the two collector plates have the same thickness.

12. The heat exchanger of claim 1, wherein a thickness of the first and second plates of the plate pack is the same and/or higher than a thickness of the collector plates.

13. The heat exchanger of claim 1, wherein the sides of the plates are from 50 mm to 1000 mm long.

14. The heat exchanger of claim 1, wherein a width of the non-intersecting cutouts in the first and second plates is from 3 mm to 20 mm.

15. The heat exchanger of claim 1, wherein all non-intersecting cutouts of a plate are of the same width.

16. The heat exchanger of claim 1, wherein an angle formed between an edge of a plate and a cutout from whose vicinity the cutout originates is from 10 degrees to 75 degrees.

17. The heat exchanger of claim 1, wherein the non-intersecting cutouts of a plate are parallel to each other.

18. The heat exchanger of claim 1, wherein the plates are connected to each other by diffusion welding.

19. A heat exchanger unit, wherein the unit is suitable for use in the heat exchanger of claim 1 and comprises four rectangular plates of identical outer dimensions, namely a plate pack comprising a first plate having non-intersecting cutouts therein and an adjacent second plate having non-intersecting cutouts therein, the non-intersecting cutouts of the first and second plates extending transversely from a vicinity of an edge at one side of the first or second plate towards a vicinity of an edge at an opposite side of the plate, the first and second plates both additionally comprising two longitudinal collector cutouts which extend parallel to, and in proximity of plate edges which are perpendicular to edges from which the non-intersecting cutouts originate, each longitudinal collector cutout merging into a collector hole at a corner of the respective plate, the plate pack being sandwiched between two collector plates without non-intersecting cutouts and longitudinal collector cutouts but with a collector hole at each of its four corners, two of the collector holes being located above or below the two collector holes of a first or second plate of the plate pack, the non-intersecting cutouts of the first and second plates forming two groups of cutouts, namely (i) a first group of cutouts which are closed at both ends thereof in vicinities of the edges at opposite sides of the plate, and (ii) a second group of cutouts having one end that is closed in a vicinity of an edge at a side of the plate from which the cutout extends, the other end merging into one of the longitudinal collector cutouts of the plate, thereby forming gaps in a longitudinal collector cutout, and wherein the two plates of the plate pack are identical or differ with respect to at least one of thickness of the plate, number of cutouts, width of cutouts, distance between cutouts, configuration of cutouts, and inclination of cutouts, one of the first and second plates being rotated from a parallel orientation by 180° around a central symmetry axis of the first and second plates which is parallel to the sides along which the longitudinal collector cutouts extend, resulting in at least some of the non-intersecting cutouts of the first plate intersecting at least some of the non-intersecting cutouts of the second plate.

20. A plate pack, wherein the plate pack is suitable for use in the heat exchanger unit of claim 19 and comprises a first rectangular plate having non-intersecting cutouts therein and an adjacent second rectangular plate having non-intersecting cutouts therein, the non-intersecting cutouts of the first and second plates extending transversely from a vicinity of an edge at one side of the first or second plate towards a vicinity of an edge at an opposite side of the plate, the first and second plates both additionally comprising two longitudinal collector cutouts which extend parallel to, and in proximity of plate edges which are perpendicular to edges from which the non-intersecting cutouts originate, each longitudinal collector cutout merging into a collector hole at a corner of the respective plate, the non-intersecting cutouts of the first and second plates forming two groups of cutouts, namely (i) a first group of cutouts which are closed at both ends thereof in vicinities of the edges at opposite sides of the plate, and (ii) a second group of cutouts having one end that is closed in a vicinity of an edge at a side of the plate from which the cutout extends, the other end merging into one of the longitudinal collector cutouts of the plate, thereby forming gaps in a longitudinal collector cutout, and wherein the two plates of the plate pack are identical or differ with respect to at least one of thickness of the plate, number of cutouts, width of cutouts, distance between cutouts, configuration of cutouts, and inclination of cutouts, and one of the first and second plates being rotated from a parallel orientation by 180° around a central symmetry axis of the first and second plates which is parallel to the sides along which the longitudinal collector cutouts extend, resulting in at least some of the non-intersecting cutouts of the first plate intersecting at least some of the non-intersecting cutouts of the second plate.

* * * * *